US010317018B2

(12) United States Patent
Kim

(10) Patent No.: US 10,317,018 B2
(45) Date of Patent: Jun. 11, 2019

(54) LIGHTING DEVICE

(71) Applicant: LG INNOTEK CO., LTD., Seoul (KR)

(72) Inventor: Eun Hwa Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/753,874

(22) PCT Filed: Aug. 19, 2016

(86) PCT No.: PCT/KR2016/009165
§ 371 (c)(1),
(2) Date: Feb. 20, 2018

(87) PCT Pub. No.: WO2017/039198
PCT Pub. Date: Mar. 9, 2017

(65) Prior Publication Data

US 2019/0011088 A1 Jan. 10, 2019

(30) Foreign Application Priority Data

Sep. 1, 2015 (KR) ..... 10-2015-0123441
Sep. 1, 2015 (KR) ..... 10-2015-0123442

(51) Int. Cl.
*F21K 9/62* (2016.01)
*F21K 5/04* (2006.01)
(Continued)

(52) U.S. Cl.
CPC ..... *F21K 9/62* (2016.08); *F21K 9/69* (2016.08); *F21K 99/00* (2013.01); *F21V 5/04* (2013.01);
(Continued)

(58) Field of Classification Search
USPC ..... 362/297, 311.06, 245, 311.02, 311.07, 362/335, 800; 257/100, 98, 99;
(Continued)

(56) References Cited

U.S. PATENT DOCUMENTS 8,313,218 B2 * 11/2012 Hong ..... F21V 5/00 362/267
8,817,116 B2 * 8/2014 Kim ..... G03B 5/00 348/208.7
(Continued)

FOREIGN PATENT DOCUMENTS

KR 10-2010-0032294 3/2010
KR 10-2012-0129472 11/2012
(Continued)

OTHER PUBLICATIONS

International Search Report (with English Translation) and Written Opinion dated Nov. 25, 2016 issued in Application No. PCT/KR2016/009165.

*Primary Examiner* — David A Vanore
(74) *Attorney, Agent, or Firm* — Ked & Associates, LLP

(57) ABSTRACT

An exemplary embodiment of the present invention comprises: a light-emitting part including a board and a plurality of light-emitting devices disposed on an upper surface of the board; a first reflection surface located on one side of the light-emitting part; and a second reflection surface located on the other side of the light-emitting part, wherein the first reflection surface and the second reflection surface comprise a reflection part having a parabola shape; and a lens disposed on the light-emitting part between the first reflection surface and the second reflection surface, and each of the light-emitting devices is arranged to be aligned with a parabola-shaped focus, and the height of the reflection part is defined by equation 1.

20 Claims, 13 Drawing Sheets

(51) Int. Cl.

| | |
|---|---|
| ***F21V 7/00*** | (2006.01) |
| ***F21K 99/00*** | (2016.01) |
| ***F21V 5/04*** | (2006.01) |
| ***F21V 7/04*** | (2006.01) |
| ***F21V 7/06*** | (2006.01) |
| ***F21K 9/69*** | (2016.01) |
| *F21Y 103/10* | (2016.01) |
| *F21Y 115/10* | (2016.01) |

(52) U.S. Cl.
CPC ..... *F21V 7/00* (2013.01); *F21V 7/005* (2013.01); *F21V 7/0066* (2013.01); *F21V 7/04* (2013.01); *F21V 7/06* (2013.01); *F21Y 2103/10* (2016.08); *F21Y 2115/10* (2016.08)

(58) Field of Classification Search
USPC ..... 250/504 R
See application file for complete search history.

(56) References Cited

U.S. PATENT DOCUMENTS

| | | | | |
|---|---|---|---|---|
| 8,841,687 | B2 * | 9/2014 | Moon | H01L 33/486 257/98 |
| 9,117,971 | B2 * | 8/2015 | Jeong | H01L 33/145 |
| 9,134,230 | B2 * | 9/2015 | Jiang | G01N 21/6486 |
| 9,148,553 | B2 * | 9/2015 | Kim | H04N 5/2257 |
| 9,253,859 | B2 * | 2/2016 | Chung | F21V 23/0435 |
| 9,300,849 | B2 * | 3/2016 | Lee | G03B 3/10 |
| 9,319,573 | B2 * | 4/2016 | Oh | G02B 7/08 |
| 9,412,908 | B2 * | 8/2016 | Jeong | H01L 33/62 |
| 9,528,693 | B2 * | 12/2016 | Lim | F21V 3/0625 |
| 9,893,259 | B2 * | 2/2018 | Kim | H01L 33/58 |
| 9,903,562 | B2 * | 2/2018 | Park | H01L 33/507 |
| 9,935,248 | B2 * | 4/2018 | Kong | H01L 33/507 |
| 9,947,835 | B2 * | 4/2018 | Seo | H01L 33/44 |
| 9,979,870 | B2 * | 5/2018 | Park | G03B 15/05 |
| 9,995,461 | B2 * | 6/2018 | Lee | G02B 19/0028 |
| 9,997,683 | B2 * | 6/2018 | Ryu | H01L 29/866 |
| 10,020,248 | B2 * | 7/2018 | Yoo | H01L 23/49572 |
| 10,042,234 | B2 * | 8/2018 | Kim | G02B 3/14 |
| 10,067,381 | B2 * | 9/2018 | Park | G02F 1/133603 |
| 2008/0247170 | A1 * | 10/2008 | Peck | F21V 7/0008 362/297 |
| 2011/0255290 | A1 * | 10/2011 | Kazmierski | F21V 5/048 362/296.05 |
| 2012/0044682 | A1 * | 2/2012 | Allen | F21V 5/045 362/241 |
| 2012/0051058 | A1 * | 3/2012 | Sharma | F04B 43/046 362/294 |
| 2012/0242931 | A1 * | 9/2012 | Jung | G02F 1/13363 349/62 |
| 2013/0194802 | A1 * | 8/2013 | Kim | F21V 5/04 362/245 |
| 2014/0240978 | A1 * | 8/2014 | Kim | F21V 15/01 362/235 |
| 2014/0313731 | A1 * | 10/2014 | Kwak | F21V 29/004 362/294 |
| 2014/0328061 | A1 * | 11/2014 | Jang | F21V 5/007 362/237 |
| 2015/0054005 | A1 * | 2/2015 | Kim | H01L 33/58 257/89 |
| 2015/0204508 | A1 * | 7/2015 | Kim | F21V 5/04 362/311.06 |
| 2018/0290462 | A1 * | 10/2018 | Kain | B41J 11/002 |
| 2018/0292067 | A1 * | 10/2018 | Kim | F21V 5/04 |
| 2019/0011088 | A1 * | 1/2019 | Kim | F21K 99/00 |

FOREIGN PATENT DOCUMENTS

| | | |
|---|---|---|
| KR | 10-1355815 | 1/2014 |
| KR | 10-2014-0124270 | 10/2014 |
| KR | 10-2014-0131018 | 11/2014 |
| WO | WO 2013/036484 | 3/2013 |

* cited by examiner

| | a | Z | PD | F1 | D | α | β | LD | LZ | Lens Radius | Lens Thickness |
|---|---|---|---|---|---|---|---|---|---|---|---|
| Case 1 | 1.05 | 2.5 | 7.7 | 1.05 | 4.2 | 32.95 | 57.05 | 2.74 | 1.77 | 1.30 | 3.30 |
| Case 2 | 1.05 | 3.2 | 8.4 | 1.05 | 4.2 | 36.87 | 53.13 | 2.74 | 2.05 | 1.60 | 2.78 |
| Case 3 | 1.05 | 7.2 | 11.8 | 1.05 | 4.2 | 50.69 | 39.31 | 2.74 | 3.34 | 2.30 | 2.09 |
| Case 4 | 1.05 | 15.8 | 16.8 | 1.05 | 4.2 | 61.93 | 28.07 | 2.74 | 5.13 | 2.80 | 1.80 |
| Case 5 | 1.05 | 25.2 | 21.0 | 1.05 | 4.2 | 67.38 | 22.62 | 2.74 | 6.57 | 3.60 | 1.51 |
| Case 6 | 1.05 | 36.8 | 25.2 | 1.05 | 4.2 | 71.08 | 18.92 | 2.74 | 7.98 | 4.30 | 1.35 |
| Case 7 | 1.05 | 50.4 | 29.4 | 1.05 | 4.2 | 73.74 | 16.26 | 2.74 | 9.38 | 5.00 | 1.23 |
| Case 8 | 1.05 | 66.2 | 33.6 | 1.05 | 4.2 | 75.75 | 14.25 | 2.74 | 10.78 | 7.00 | 1.02 |

| CASE | α (°) | β (°) | Max intensity | | Increase |
|---|---|---|---|---|---|
| | | | Without Lens | With Lens | |
| Case 1 | 33 | 57 | 14.2 | 22.7 | 60.2% |
| Case 2 | 37 | 53 | 45.8 | 25.7 | 62.3% |
| Case 3 | 51 | 39 | 24.0 | 32.0 | 33.5% |
| Case 4 | 62 | 28 | 36.8 | 44.4 | 20.6% |
| Case 5 | 67 | 23 | 47.8 | 54.1 | 13.1% |
| Case 6 | 71 | 19 | 58.8 | 64.3 | 9.4% |
| Case 7 | 74 | 16 | 69.5 | 73.7 | 6.0% |
| Case 8 | 76 | 14 | 79.5 | 81.9 | 3.0% |

FIG. 15

| CASE | LES | a1 | ED2 / 2 (b) | F1 | F2 | R | D (1.2A) | k | F | θ |
|---|---|---|---|---|---|---|---|---|---|---|
| 1 | ø 3.5 mm | 5 | 3.875 | 1.840194 | 8.159806 | 3.003125 | 6.0063 | -0.39938 | 3.159806 | 51 |
| 2 | ø 3.5 mm | 5.3344 | 4.0008 | 1.806026 | 8.862774 | 3.0006 | 6.0012 | -0.4375 | 3.528374 | 49 |
| 3 | ø 3.5 mm | 7.68 | 4.8 | 1.684802 | 13.6752 | 3 | 6.0000 | -0.60938 | 5.995198 | 39 |
| 4 | ø 3.5 mm | 12 | 6 | 1.607695 | 22.3923 | 3 | 6.0000 | -0.75 | 10.3923 | 30 |
| 5 | ø 3.5 mm | 21.33333 | 8 | 1.556804 | 41.10986 | 3 | 6.0000 | -0.85938 | 19.77653 | 22 |
| 6 | ø 3.5 mm | 48 | 12 | 1.5242 | 94.4758 | 3 | 6.0000 | -0.9375 | 46.4758 | 14 |

FIG. 16

| ø 3.5 mm | | | | |
|---|---|---|---|---|
| CASE | θ | Total collected power (W) | Detector collected power (W) | Rate |
| 1 | 51 | 5.6834113 | 3.155731 | 0.555253 |
| 2 | 49 | 5.216751487 | 3.386409 | 0.649141 |
| 3 | 39 | 5.498042938 | 3.333332 | 0.606276 |
| 4 | 30 | 5.513410518 | 2.690898 | 0.488064 |
| 5 | 22 | 5.44252887 | 1.639615 | 0.30126 |
| 6 | 14 | 5.401126559 | 0.742133 | 0.137403 |

FIG. 17

| CASE | LES | a1 | ED2/2 (b) | F1 | F2 | R | D (1.24A) | k | F | θ |
|---|---|---|---|---|---|---|---|---|---|---|
| 1 | ø 14.5 mm | 14.992 | 11.6188 | 5.517637 | 24.46636 | 9.00457 | 18.0091 | -0.39938 | 9.474363 | 51 |
| 2 | ø 14.5 mm | 16.0032 | 12.0024 | 5.418078 | 26.58832 | 9.0018 | 18.0036 | -0.4375 | 10.58512 | 49 |
| 3 | ø 14.5 mm | 23.04 | 14.4 | 5.054406 | 41.02559 | 9 | 18.0000 | -0.60938 | 17.98559 | 39 |
| 4 | ø 14.5 mm | 36 | 18 | 4.823085 | 67.17691 | 9 | 18.0000 | -0.75 | 31.17691 | 30 |
| 5 | ø 14.5 mm | 64 | 24 | 4.670412 | 123.3296 | 9 | 18.0000 | -0.85938 | 59.32959 | 22 |
| 6 | ø 14.5 mm | 144 | 36 | 4.5726 | 283.4274 | 9 | 18.0000 | -0.9375 | 139.4274 | 14 |

| ø 14.5 mm | | | | |
|---|---|---|---|---|
| CASE | θ | Total collected power (W) | Detector collected power (W) | Rate |
| 1 | 51 | 5.564993902 | 3.317545 | 0.596145 |
| 2 | 49 | 5.058321581 | 3.394865 | 0.671145 |
| 3 | 39 | 5.242638193 | 2.975476 | 0.567553 |
| 4 | 30 | 5.3313 | 2.383462 | 0.44707 |
| 5 | 22 | 5.375267931 | 1.527812 | 0.28423 |
| 6 | 14 | 5.302687584 | 0.710453 | 0.13398 |

LIGHTING DEVICE

CROSS-REFERENCE TO RELATED PATENT APPLICATIONS

This application is a U.S. National Stage Application under 35 U.S.C. § 371 of PCT Application No. PCT/KR2016/009165, filed Aug. 19, 2016, which claims priority to Korean Patent Application No. 10-2015-0123441, and Korean Patent Application No. 10-2015-0123442, both filed Sep. 1, 2015, whose entire disclosures are hereby incorporated by reference.

TECHNICAL FIELD

Embodiments relate to a lighting device including light emitting elements.

BACKGROUND ART

In general, a light emitting diode (LED) is a device that emits light when electrons and holes meet at a P-N junction by applying a current. The LED has many advantages over conventional light sources, such as continuous light emission at a low voltage and low current and low power consumption.

Particularly, LEDs are widely used for various display devices, backlight sources, and the like. In recent years, technologies for emitting white light by using three light emitting diode chips emitting red, green and blue light respectively or by using a fluorescent substance to convert the wavelength of light have been developed and are expanding in application range even to lighting devices.

An LED that emits ultraviolet light may be used in water purifiers, sterilizers, and the like for the purpose of sterilization, cleaning, and the like, and may also be used in an exposure apparatus that forms a photoresist pattern. Particularly, for a light emitting module including the LED for emitting ultraviolet light used in the exposure apparatus, it is important to concentrate light on a certain target area.

When the LED, which has a relatively small light amount compared to a lamp having a large light amount, is used as a light source to concentrate the power of the light source on an optical fiber or a detector having a size comparable to that of the light source, it is difficult to concentrate the power of the light source over the entire area of the detector using the simple form of a reflector.

DISCLOSURE

Technical Problem

Embodiments provide a lighting device capable of uniformly condensing light on a target having a certain area.

Technical Solution

In one embodiment, a lighting device may include a light emitting unit including a board and a plurality of light emitting elements disposed on a top surface of the board, a reflector including a first reflective surface positioned on one side of the light emitting unit and a second reflective surface positioned on an opposite side of the light emitting unit, the first reflective surface and the second reflective surface having a parabolic shape, and a lens disposed on the light emitting unit between the first reflective surface and the second reflective surface, wherein each of the light emitting elements is arranged to be aligned with a focus of the parabolic shape, and a height of the reflector is defined by Equation 1 defined as follows:

$$Z = \frac{(PD/2)^2}{4a}, \qquad \text{Equation 1}$$

where Z may be the height of the reflector, a may be a focal length of the parabolic shape, and PD may be a distance from an uppermost end of the first reflective surface to an uppermost end of the second reflective surface.

$Z \geq 0.89$ A, and A may be a diameter of the light emitting elements.

A distance between a lowermost end of the first reflective surface and a lowermost end of the second reflective surface may be greater than or equal to 4a.

The lens may include a refractor including an incidence surface on which light emitted from the light emitting elements is incident, and an exit surface through which light passing through the incidence surface passes, wherein the light passing through the refractor wearing output in parallel with a direction perpendicular to the top surface of the board.

A diameter of the incidence surface of the lens may be defined by Equation 2 as follows:

$$LD=(2\alpha\times\tan\theta+\sqrt{(2\alpha\times\tan\theta)^2+4\alpha^2})\times 2, \qquad \text{Equation 2}$$

where LD may be the diameter of the incidence surface of the lens, and θ may be an angle of light emitted from the light emitting elements having a luminous intensity of 10% of a maximum value of an intensity distribution.

A height of the lens may be defined by Equation 3 as follows:

$$LZ = \tan\alpha \times \frac{LD}{2}, \qquad \text{Equation 3}$$

where LZ may be the height of the lens, and a may be an angle between the top surface of the board and a reference line, wherein the reference line may be an imaginary line connecting a center of each of the light emitting elements and an uppermost end of the first reflective surface or the second reflective surface.

α may be 33° to 67°. Alternatively, α may be 33° to 51°. Alternatively, α may be 33° to 37°.

A first edge of the lens may contact the first reference line, and a second edge of the lens may contact the second reference line, wherein and the first reference line may be an imaginary line connecting a center of each of the light emitting elements and an uppermost end of the first reflective surface, and the second reference line may be an imaginary line connecting the center of each of the light emitting elements and an uppermost end of the second reflective surface.

The lens may further include a support connected to the refractor and fixed to the top surface of the board, wherein the support may be coupled to a second region of the top surface other than a first region of the board, the light emitting elements being positioned in the first region.

The lighting device may further include a housing having a cavity for accommodating the light emitting unit, the reflector, and the lens, wherein an inner wall of the housing may be provided with a protruding support for supporting opposite ends of the lens.

Each of the light emitting elements may generate ultraviolet light in a wavelength range of 200 nm to 400 nm.

In another embodiment, a lighting device may include a light emitting unit including a board and at least one light emitting element disposed on a top surface of the board, a reflector including a first opening positioned around the light emitting unit, a second opening positioned over the first opening and allowing light emitted from the light emitting unit to be output therethrough, and a reflector including a reflective surface positioned between the first opening and the second opening, and a lens disposed on the light emitting unit on an inner side of the reflective surface and having an incidence surface and an exit surface, wherein the reflective surface may be an elliptic shape and a corner where the incidence surface and the exit surface of the lens meet is aligned to contact a reference line, wherein the reference line may be an imaginary line connecting a center of the at least one light emitting element and an uppermost end of the reflective surface, wherein an angle between a vertical reference line and the reference line may be 30° to 51°, wherein the vertical reference line may be an imaginary line passing through a center of the reflector and a center of the lens and perpendicular to the top surface of the board.

A diameter of the first opening of the reflector may be greater than or equal to 1.2 times a diameter of a light emitting surface of the light emitting element and be less than or equal to 5.0 times the diameter of the light emitting surface of the light emitting element.

A height of the lens may be half a height of the reflector.

40% or more of a total collected power may be concentrated on a target spaced apart from a lower surface of the reflector and positioned in front of the second opening.

A diameter of the target may be greater than or equal to 1.2 times a diameter of a light emitting surface of the light emitting element and be less than or equal to 1.5 times the diameter of the light emitting surface of the light emitting element.

A distance from the lower surface of the reflector to the target may be greater than or equal to 1.0 time a diameter of a light emitting surface of the light emitting element and be less than or equal to 4.5 times the diameter of the light emitting surface of the light emitting element.

A diameter of the lens may be defined by Equations 4 and 5 as follows:

$$LD2=k\times B, \text{ and} \quad \text{Equation 4}$$

$$B=2\times LH2\times\tan(\theta), \quad \text{Equation 5}$$

where LD2 may be the diameter of the lens, B may be half a diameter of the second opening, $0.8\leq k\leq 1$, LH2 may be a height of the lens, and θ may be the angle between the vertical reference line and the reference line.

Advantageous Effects

According to embodiments, light may be uniformly condensed on a target having a certain area.

DESCRIPTION OF DRAWINGS

FIG. 15 shows conditions for each case for the simulation result of FIG. 16.

FIG. 16 shows a simulation result of light condensation of the lighting device according to FIG. 15.

FIG. 17 shows conditions for each case for the simulation result of FIG. 18.

BEST MODE

Figure 1:
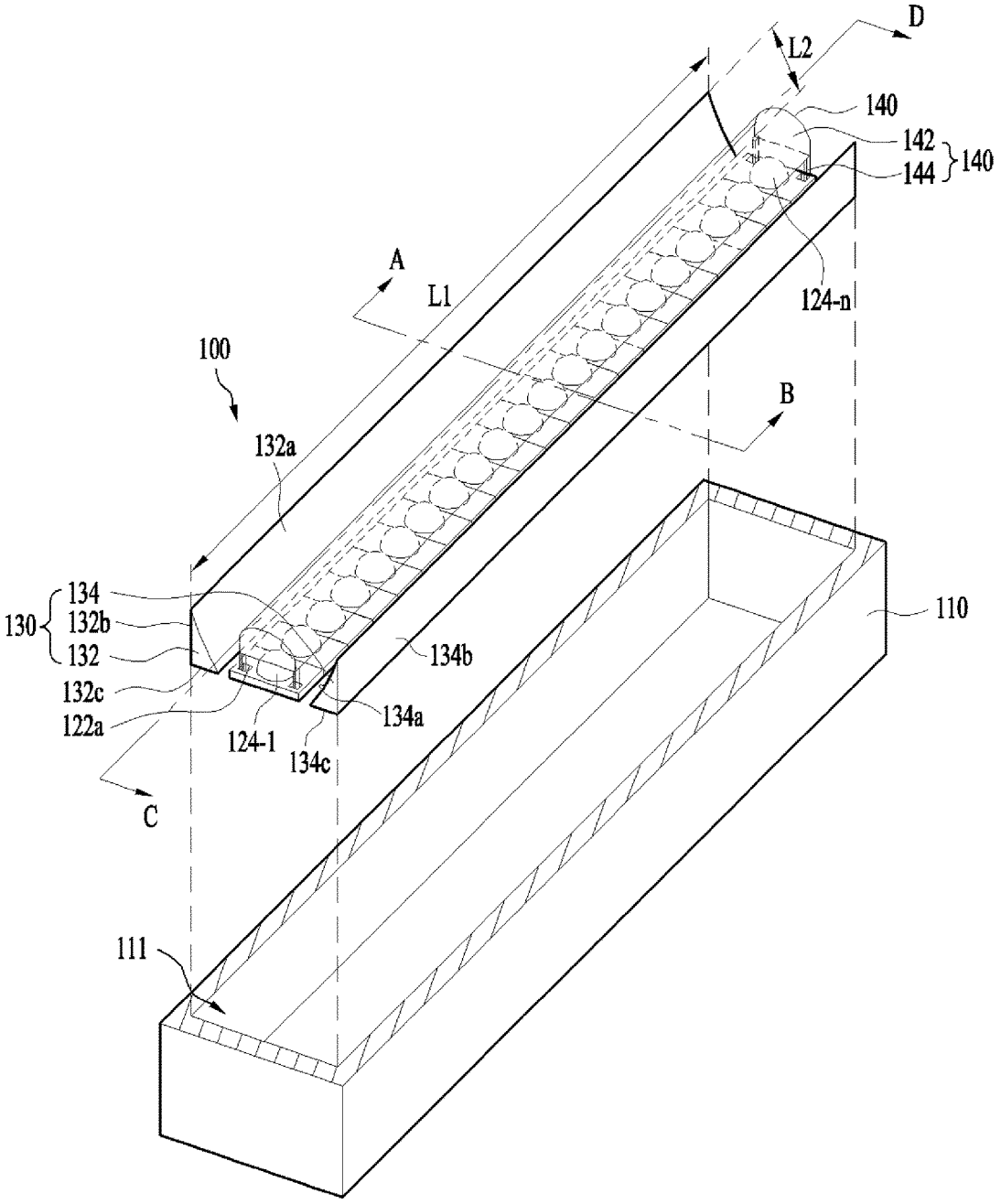
FIG. 1 shows an exploded perspective view of a lighting device according to an embodiment.

Hereinafter, embodiments will be more clearly understood from the following description taken in conjunction with the accompanying drawings. In the description of the embodiments, it is to be understood that when a layer (film), region, pattern or structure is described as being "on" or "under" a substrate, each layer (film), region, pad, or pattern, the terms "on" and "under" conceptually include "directly" or "indirectly". In the description, "on" or "under" is defined based on the drawings.

It will be appreciated that for simplicity and clarity of illustration, the dimensions of some of the elements are exaggerated, omitted, or schematically shown relative to other elements. In addition, elements shown in the drawings have not necessarily been drawn to scale. Wherever possible, the same reference numbers will be used throughout the drawings to refer to the same or like parts.

Figure 2A:
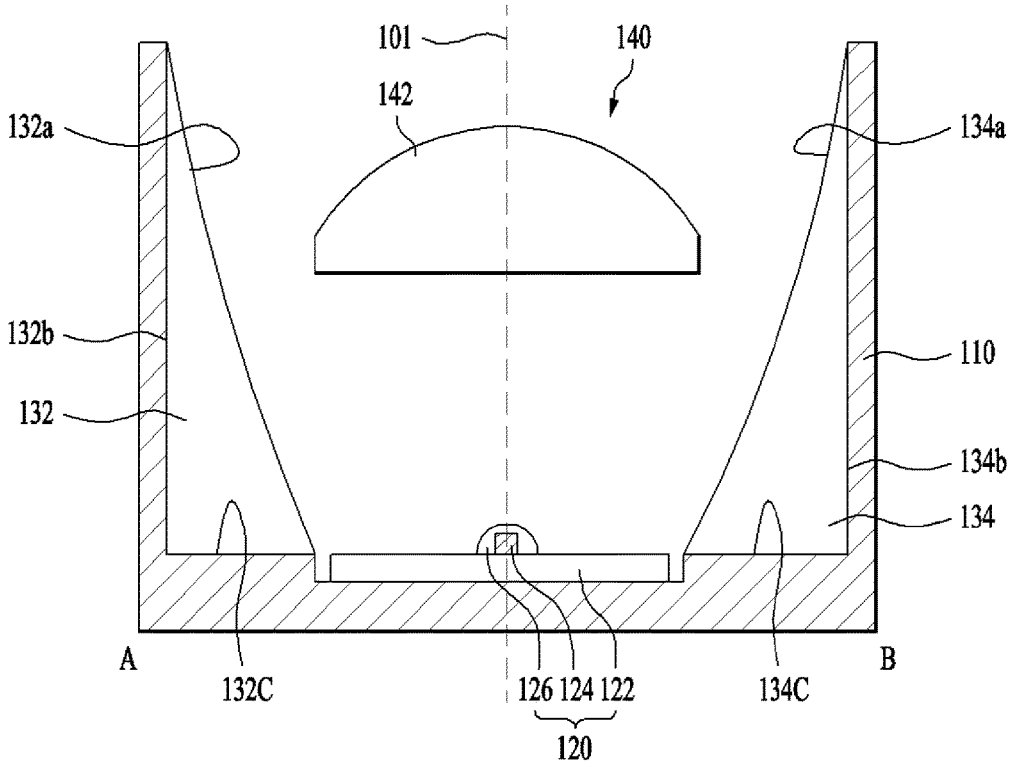
FIG. 2A shows a cross-sectional view of the lighting device shown in FIG. 1, taken along line AB.
Figure 2B:
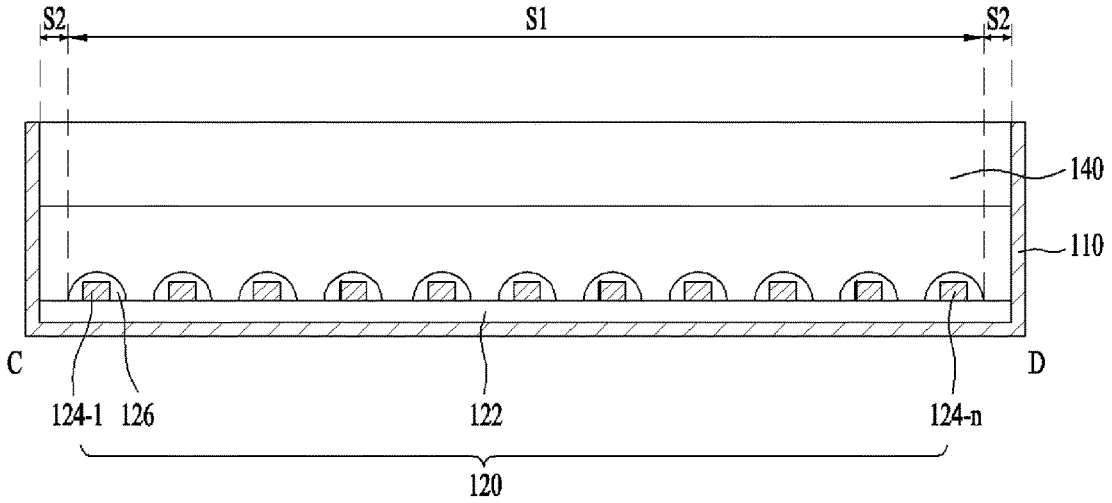
FIG. 2B shows a cross-sectional of the lighting device shown in FIG. 1, taken along line CD.

FIG. 1 shows an exploded perspective view of a lighting device 100 according to an embodiment, FIG. 2A shows a cross-sectional view of the lighting device 100 shown in FIG. 1, taken along line AB, and FIG. 2B shows a cross-sectional of the lighting device 100 shown in FIG. 1, taken along line CD.

Referring to FIGS. 1, 2A, and 2B, the lighting device 100 includes a housing 110, a light emitting unit 120, a reflector 130, and a lens 140.

The housing 110 has a cavity 111 for accommodating the light emitting unit 120, the reflector 130, and the lens 140.

The housing 110 may be formed of a plastic material having a light weight and high thermal resistance, or a metal material having a high thermal conductivity such as, for example, aluminum. The inner wall of the housing 110 may be coated with a reflective material capable of reflecting light emitted from the light emitting unit 120. In another embodiment, the housing 110 may be formed of a reflective material that reflects light.

The light emitting unit 120 is disposed in the housing 110 and emits light.

The light emitting unit 120 may include a board 122, and a light emitting element 124. The light emitting unit 120 may further include a resin layer 126 capable of protecting the light emitting element 124 and refracting light emitted from the light emitting element 124. Here, the resin layer 126 may serve as a lens for refracting light.

The board 122 of the light emitting unit 120 may be a plate-shaped structure on which the light emitting element 124 and an element capable of supplying power to the light emitting element 124, controlling the light emitting element, or protecting the light emitting element may be mounted.

For example, the board 122 may be a printed circuit board or a metal PCB. In FIG. 2B, the board 122 may have a rectangular parallelepiped shape. However, embodiments are not limited thereto. The board may have a circular, elliptical, or polyhedral plate shape.

The light emitting element 124 is disposed on one surface (e.g., the top surface) of the board 122. The light emitting element 124 may be a light emitting diode (LED)-based light source, but is not limited thereto. For example, the light emitting element 124 may take the form of an LED chip, or an LED package.

The number of the light emitting elements 124 may be greater than or equal to 1. While it is illustrated in FIG. 1 that a plurality of light emitting elements 124-1 to **124-*n* (where n is a natural number greater than 1) is disposed in a line on the board 122, embodiments are not limited thereto. The plurality of light emitting elements 124-1 to 124-*n* (where n is a natural number greater than 1) may be disposed in various shapes such as a circular shape or a matrix shape on the board 122**.

The light emitting elements 124-1 to **124-*n* (where n is a natural number greater than 1) may emit rays in the same wavelength range or similar wavelength ranges. Alternatively, at least one of the light emitting elements 124-1 to 124-*n*** (where n is a natural number greater than 1) may emit light in a different wavelength range.

For example, each of the light emitting elements 124-1 to **124-*n* (where n is a natural number greater than 1) may generate ultraviolet light having a wavelength range of 200 nm to 400 nm. Alternatively, for example, each of the light emitting elements 124-1 to 124-*n*** (where n is a natural number greater than 1) may generate ultraviolet-C (UVC) in a wavelength range of 200 nm to 280 nm.

The reflector 130 may include a first reflective surface **132*a* positioned on one side of the light emitting unit 120 and a second reflective surface 132*b* positioned on the opposite side of the light emitting unit 120 and facing the first reflective surface 132*a***.

The first reflective surface **132*a* and the second reflective surface 134*a*** may have a parabolic shape or have a curvature of a parabola.

For example, the curved surface where the extended line of the first reflective surface **132*a* meets the extended line of the second reflective surface 134*a* may be parabolic, and the light emitting elements 124-1 to 124-*n*** (where n is a natural number greater than 1) may be arranged so as to be aligned at the focus of the parabolic shape.

The reflector 130 may include a first reflector 132 positioned at one side of the light emitting unit 120 and a second reflector 134 positioned at the opposite side of the light emitting unit 120. As shown in FIGS. 1, 2A, and 2B, the first and second reflectors 132 and 134 are spaced apart from each other, but embodiments are not limited thereto. In another embodiment, one end of the first reflector 132 and one end of the second reflector 134 may be connected to each other and the opposite end of the first reflector 132 and the opposite end of the second reflector 134 may be connected to each other.

For example, the first reflector 132 may include a first reflective surface **132*a* facing the light emitting unit 120, a first side surface 132*b* positioned opposite the first reflective surface 132*a*, and a first lower surface 132*c* positioned between the first reflective surface 132*a* and the first side surface 132*b***.

The second reflector 134 may include a second reflective surface **134*a* facing the light emitting unit 120, a second side surface 134*b* positioned opposite the second reflective surface 134*a*, and a second lower surface 134*c* positioned between the second reflective surface 134*a* and the second side surface 134*b***.

For example, the length L1 of the upper side (or lower side) of the first reflective surface **132*a* may be greater than the length L2 from the upper end to the lower end of the first reflective surface 132*a*. The length of the upper side (or lower side) of the second reflective surface 134*a* may be greater than the length from the upper end to the lower end of the second reflective surface 134*a***.

For example, the lengths of the upper side and the lower side of the first reflective surface **132*a* may be equal to each other, and the lengths of the upper side and the lower side of the second reflective surface 134*a*** may be equal to each other.

In addition, for example, the length L1 of the upper side (or lower side) of the first reflective surface **132*a* may be equal to the length L1 of the upper side (or lower side) of the second reflective surface 134*a*, but embodiments are not limited thereto. The length L1 of the upper side or lower side of each of the first reflective surface 132*a* and the second reflective surface 134*a* may be increased or decreased depending on the number and arrangement of the light emitting elements of the light emitting unit 120**.

The first reflector 132 and the second reflector 134 are spaced apart from each other, and the light emitting unit 120 may be positioned in a space between the first reflector 132 and the second reflector 134.

The first reflective surface **132*a* and the second reflective surface 134*a* may be symmetrical with respect to a vertical reference plane 101. The vertical reference plane 101 may be an imaginary plane passing through the center of the lens 140 and perpendicular to the top surface of the board 122. For example, the lens 140 may be bisected to be symmetrical with respect to the vertical reference plane 101**.

The reflector 130 may be formed of a reflective metal, for example, stainless steel or silver (Ag). Alternatively, the reflector 130 may be formed of a metal material causing specular reflection.

Alternatively, the reflector 130 may be formed of a resin material having high reflectivity, but embodiments are not limited thereto.

The lens 140 is disposed on the light emitting unit 120 between the first reflective surface 132 and the second reflective surface 134. For example, the center of the light emitting unit 120 and the center of the lens 140 may be aligned with each other in the vertical direction, but embodiments are not limited thereto.

For example, the lens 140 refracts and transmits the light emitted from the light emitting unit 120.

The lens 140 may include a refractor 142 which is convex in a direction pointing from the lower end to the upper end of the reflector 130 or pointing from the light emitting unit 120 to the lens 140 and a support 144 provided on the lower surface of the refractor 142.

The support 144 of the lens 140 may be coupled to a coupling groove 122*a* provided on the top surface of the board 122 and support the lens 140.

The support 144 may take the form of a leg. At least one support may be provided at one end of the lower surface of the lens 140, and at least one support may be provided at the opposite end of the lower surface of the lens 140. For example, the number of the supports 144 may be two or more.

For example, in order to suppress refraction of light emitted from the light emitting unit 120 caused by the support 144, supports may be provided on one side and the opposite side of the lower surface of the refractor 142. However, embodiments are not limited thereto.

While it is illustrated in FIG. 1 that the supports 144 of the lens 140 are coupled to a groove 122*a* provided in the board 122, embodiments are not limited thereto. In another embodiment, the supports 144 of the lens 140 may be coupled to a groove (not shown) provided in the lower surface of the cavity 111 of the housing 110. In another embodiment, the groove 122*a* may not be provided in the board 122, but the supports 144 may be fixed to the board 122 or the lower surface of the cavity 111 of the housing 110 by an adhesive member.

As shown in FIG. 2B, the support 144 may not be positioned in a first region S1 which is between the first reflective surface 132*a* and the second reflective surface 134*a* and correspond to the light emitting elements 124-1 to 124-*n* (where n is a natural number greater than 1). For example, the support 144 of the lens 140 may be disposed in a second region S2, which is between the first reflective surface 132*a* and the second reflective surface 134*a*, other than the first region S1. For example, the support 144 may be coupled to the second region S2 other than the first region S1 of the top surface of the board 122 in which the light emitting elements 124-1 to 124-*n* (where n is a natural number greater than 1) are positioned. Here, the groove 122*a* of the board 122 to be coupled with the support 114 may also be formed in the second region S2 of the board 122.

Figure 3:
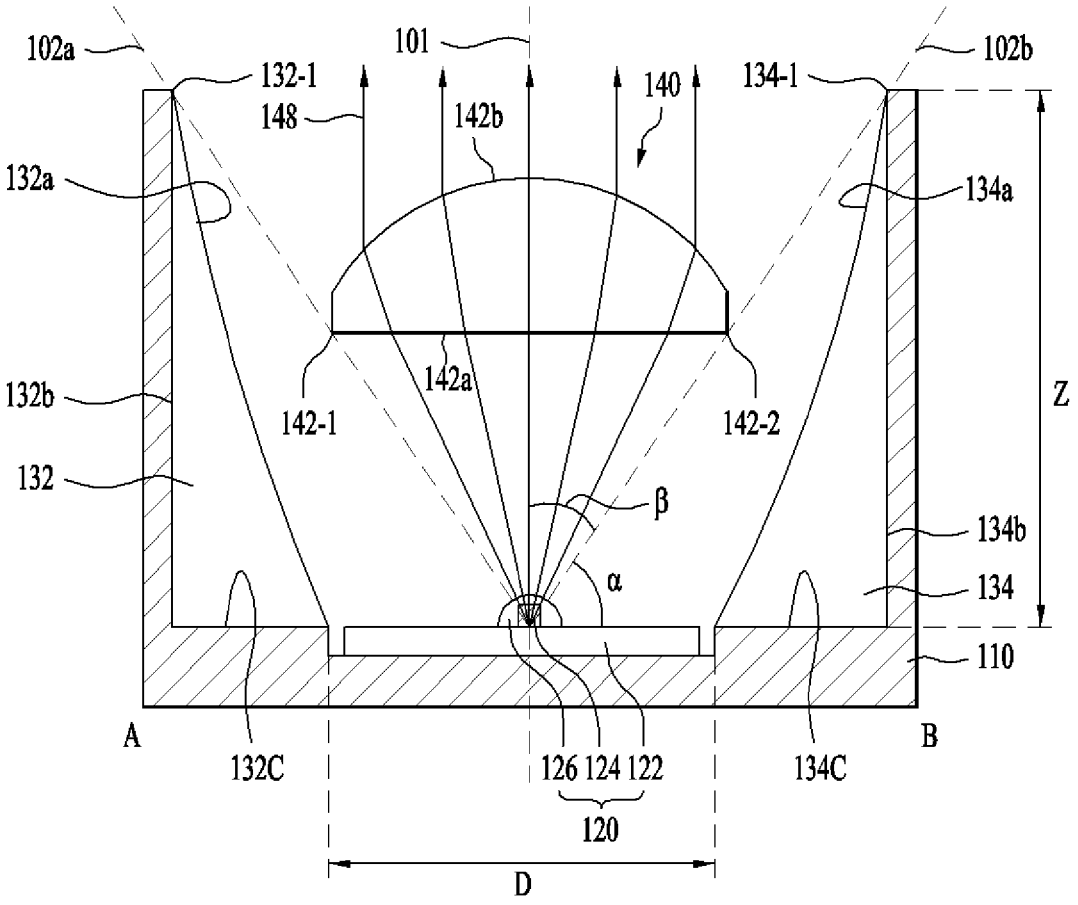
FIG. 3 shows light refracted by the lens shown in FIG. 1.
Figure 4:
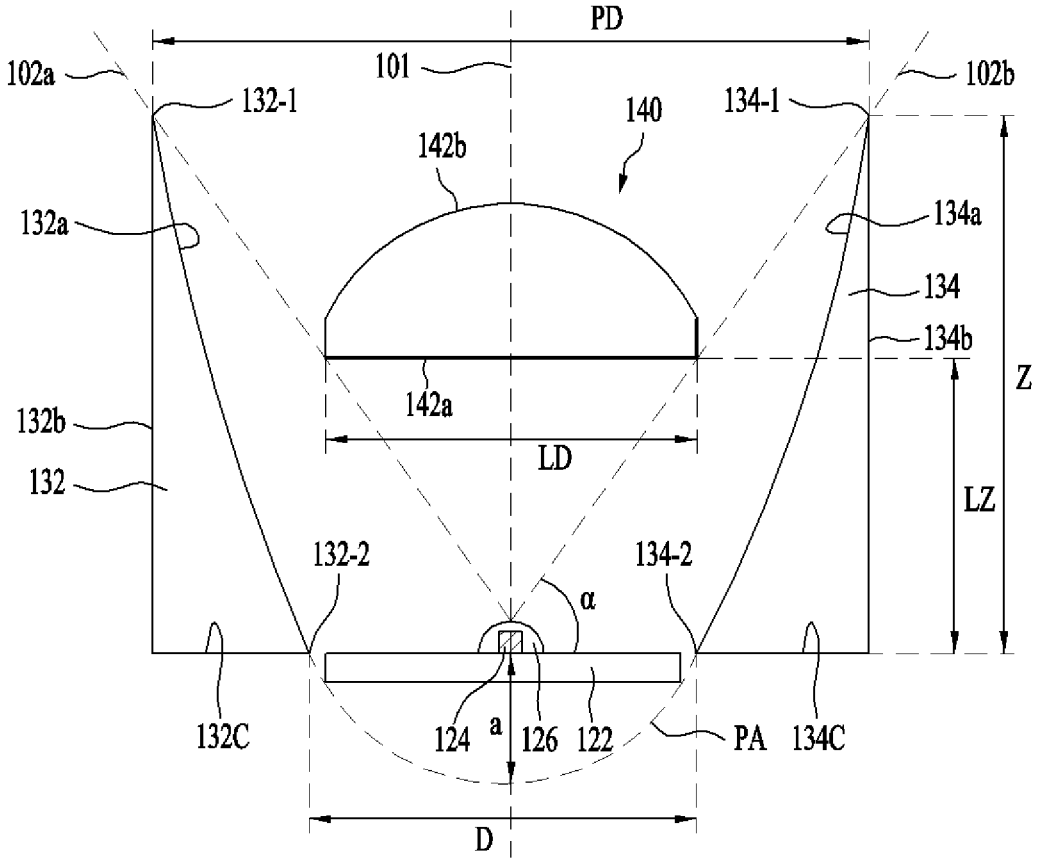
FIG. 4 shows the height of the first and second reflective surfaces shown in FIG. 3.

FIG. 3 shows light refracted by the lens 140 shown in FIG. 1, and FIG. 4 shows the height Z of the first and second reflective surfaces 132*a* and 134*a* shown in FIG. 3.

Referring to FIGS. 3 and 4, the refractor 142 of the lens 140 may include an incidence surface 142*a* and an exit surface 142*b*.

The incidence surface 142*a* of the refractor 142 of the lens 140 may be a surface on which light emitted from the light emitting elements 124-1 to 124-*n* (where n is a natural number greater than 1) is incident and refracted, and may be spaced apart from the first and second reflective surfaces 132*a* and 134*a*.

The exit surface 142*b* of the refractor 142 of the lens 140 refracts and passes the light that has passed through the incidence surface 142*a*. The light that has passed through the incidence surface 142*a* and the exit surface 142*b* of the refractor 142 of the lens 140 may be converted into rays 148 parallel to the direction pointing from the light emitting unit 120 to the lens 140.

For example, the incidence surface 142*a* of the lens 140 may be a flat surface parallel to the top surface of the board 122, and the exit surface 142*b* may have a hemispherical shape or a dome shape, for example, a parabolic shape, or an elliptical shape that is convex in a direction pointing from the light emitting unit 120 to the lens 140. However, embodiments are not limited thereto. In another embodiment, the incidence surface 142*a* and the exit surface 142*b* may be embodied in various shapes to convert the light passing through the incidence surface 142*a* and the exit surface 142*b* into parallel rays 148.

The space between the first and second reflective surfaces 132*a* and 134*a* and the space between the lens 140 and the light emitting unit 120 may be filled with a gas such as, for example, air, but embodiments are not limited thereto. In another embodiment, the spaces may be filled with a translucent material.

The lens 140 may be disposed such that a first edge 142-1 of the lens 140 adjoins a first imaginary reference line 102*a* connecting the center of the light emitting element 124 and the uppermost end 132-1 of the first reflective surface 132*a*. For example, the first edge 142-1 of the lens 140 may be a first corner of the lens 140 where the incidence surface 142*a* and the exit surface 142*b* of the lens 140 adjoin each other.

The lens 140 may be disposed such that the second edge 142-2 of the lens 140 adjoins a second imaginary reference line 102*b* connecting the center of the light emitting element 124 and the uppermost end 134-1 of the second reflective surface 134*a*. For example, the second edge 142-2 of the lens 140 may be a second corner of the lens 140 where the incidence surface 142*a* and the exit surface 142*b* of the lens 140 adjoin each other.

For example, the center of the light emitting element 124 may be the center of the light emitting surface of the light emitting element 124, and the first and second edges 142-1 and 142-2 of the lens 140 may be corners where the lateral surface and the lower surface of the light emitting element 124 meet.

The light of the light emitting element 124 emitted into a space between the first imaginary reference line 102*a* and the second imaginary reference line 102*b* may be refracted by the lens 140, and the refracted light may be converted into light 148 parallel to a direction pointing from the light emitting unit 120 to the lens 140.

In another embodiment, the first edge 142-1 and the second edge 142-2 of the lens 140 may be disposed to be spaced apart from the first reference line 102*a* and the second reference line 102*b*.

Figure 5:
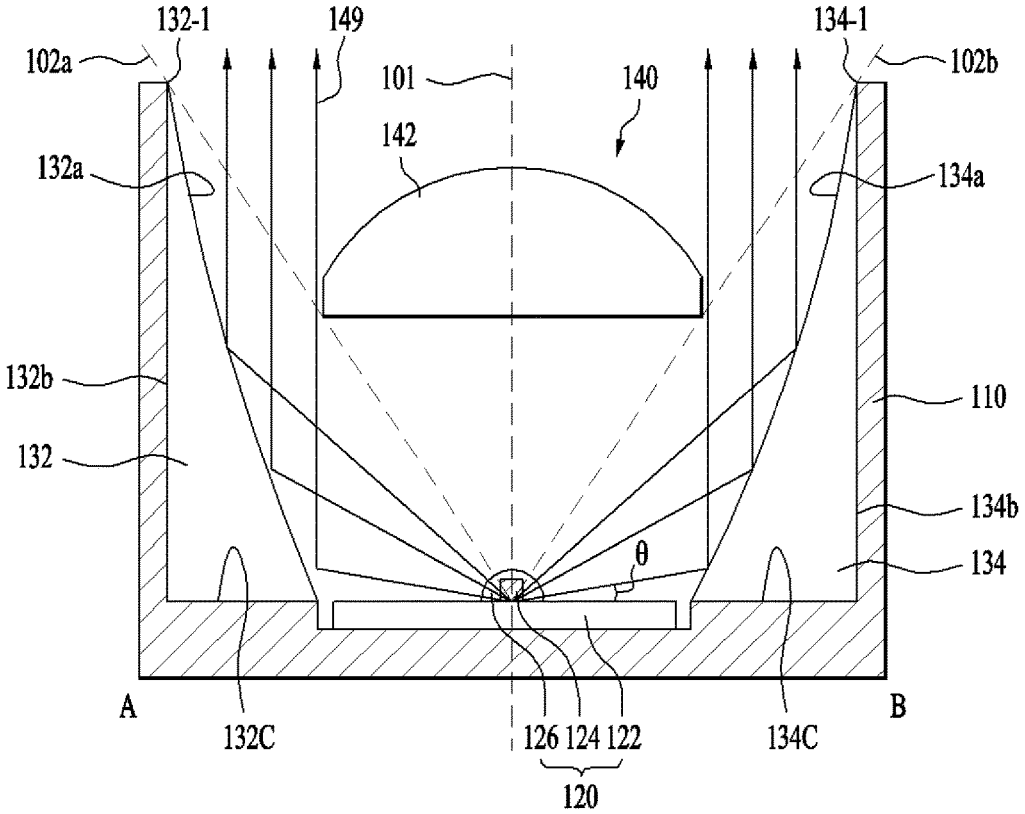
FIG. 5 shows light reflected by the reflector shown in FIG. 1.

FIG. 5 shows light reflected by the reflector 130 shown in FIG. 1.

Referring to FIG. 5, the light of the light emitting element 124 emitted downward of the first reference line 102*a* and the second reference line 102*b* is reflected by the first and second reflective surfaces 132*a* and 134*a* without being refracted by the lens 140.

Since the first and second reflective surfaces 132*a* and 134*a* have a parabolic shape, the light 149 reflected by the first and second reflective surfaces 132*a* and 134*a* may be parallel to the direction pointing from the light emitting unit 120 to the lens 140. For example, the light of the light emitting element 124 emitted downward of the first reference line 102*a* and the second reference line 102*b* may be reflected by the first and second reflective surfaces 132*a* and 134*a* and thus converted into parallel rays 149 to be output.

The height Z of the first and second reflectors 132 and 134 may be greater than or equal to 0.89 A ($Z \geq 0.89$ A). A may be the diameter of the light emitting element 124.

When the height Z of the first and second reflectors 132 and 134 is less than 0.89 A, the first and second reflective surfaces 132*a* and 134*a* are too small for the lens 140 to be disposed on the inner side of the first and second reflective surfaces 132*a* and 134*a*. The upper limit of the first and second reflectors 132 and 134 may be defined by β, which will be described later.

In an embodiment, the relationship between the height Z of the first and second reflectors 132 and 134, the position a of the light emitting elements 160-1 to 160-*m*, and the diameter PD of the light exit port of the first and second reflectors 132*a* and 132*b* may be defined as Equation 1.

$$Z = \frac{(PD/2)^2}{4a} \quad \text{Equation 1}$$

Here, Z denotes the height of the reflectors 132 and 134, for example, the distance from the bottoms 132*c* and 134*c* to the uppermost ends 132-1 and 134-1 of the first and second reflective surfaces 132*a* and 134*a*.

PD denotes the diameter of the light exit port between the first and second reflective surfaces 132*a* and 134*a*, for example, the distance from the uppermost end 132-1 of the first reflective surface 132*a* to the uppermost end 134-1 of the second reflective surface 134*a*.

a may be the distance from the lowermost end of the parabolic shape PA to the light emitting element 124. For example, a may be the focal length of the parabolic shape PA.

The distance D between the lowermost end 132-2 of the first reflective surface 132*a* and the lowermost end 134-2 of the second reflective surface 134*a* may be 4a. For example, when the light emitting element 124 is positioned at the focus of the parabolic shape PA, D may be set to 4a.

The distance D between the lowermost end 132-2 of the first reflective surface 132*a* and the lowermost end 134-2 of the second reflective surface 134*a* may be 1.2 A or more.

When the distance D between the lowermost end 132-2 of the first reflective surface 132*a* and the lowermost end 134-2 of the second reflective surface 134*a* is greater than or equal to 1.2 A, light generated from the light emitting element 124 may be transmitted to the first and second reflective surfaces 132*a* and 134*a* without loss. On the other hand, when the distance D between the lowermost end 132-2 of the first reflective surface 132*a* and the lowermost end 134-2 of the second reflective surface 134*a* is less than 1.2 A, loss of the amount of light emitted from the light emitting element 124 may occur.

The diameter LD of the incidence surface 142*a* of the lens 140 may be defined as Equation 2.

$$LD=(2\alpha\times\tan\theta+\sqrt{(2\alpha\times\tan\theta)^2+4^2})\times 2, \quad \text{Equation 2}$$

Here, θ denotes the angle of light emitted from the light emitting elements 124-1 to 124-4 corresponding to a 10% region of the maximum value of the luminous intensity in the intensity distribution of the lighting device 100, and a denotes the focal length of the parabolic shape PA.

The height LZ of the lens 140 may be defined as Equation 3.

$$LZ = \tan\alpha \times \frac{LD}{2} \quad \text{Equation 3}$$

Here, LZ may be the height of the lens 140, for example, the distance from the lower surfaces 132*c* and 134*c* of the first and second reflectors 132 and 134 to the incidence surface 142*a* of the lens 140, and α may be an angle between the horizontal reference plane and the first imaginary reference line 102*a* or an angle between the horizontal reference plane and the second imaginary reference line 102*b*. The horizontal reference plane may be a plane perpendicular to the vertical reference plane 101. For example, the horizontal reference plane may be the lower surfaces 132*c* and 134*c* of the first and second reflectors 132 and 134, or the top surface of the board 122.

Figures 7, 8, 9:
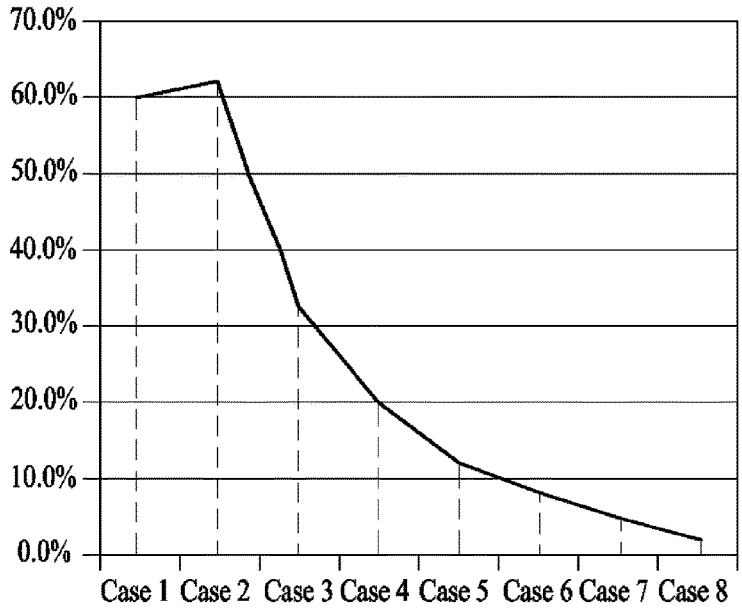
FIG. 7 shows conditions for each case for the simulation result of FIG. 8.
FIG. 8 shows a rate of increase in luminous intensity according to a simulation result based on the conditions of FIG. 7.
FIG. 9 shows a curve of maximum intensity increase rate in each case of FIG. 8.

FIG. 7 shows conditions for each case for the simulation result of FIG. 8, FIG. 8 shows a rate of increase in luminous intensity according to a simulation result based on the conditions of FIG. 7, and FIG. 9 shows a curve of maximum intensity increase rate in each case of FIG. 8.

Referring to FIG. 7, the size of each of the light emitting elements 160-1 to 160-*m* may be 2.5 mm×2.5 mm, and the length of the diagonal of each of the light emitting elements 160-1 to 160-*m* may be 3.5 mm. The light emitting elements 160-1 to 160-*m* may be aligned at the focus of a parabolic shape.

If the height Z of the first and second reflectors 132 and 134 is excessively small compared to the diameter of each of the light emitting elements 160-1 to 160-*m*, the maximum intensity increase rate of the lighting device 100 is lowered. If the height Z of the first and second reflectors 132 and 134 is excessively large compared to the diameter of each of the light emitting elements 160-1 to 160-*m*, the region for adjusting the light source becomes large and the role of the lens 140 of collecting light is weakened.

Compared to a lighting device which is not provided with the lens 140, the lighting device 100 according to the embodiment may exhibit a maximum intensity increase rate of 10% or more.

The maximum intensity of the lighting device may be used as an index for evaluating the intensity distribution of the lighting device that performs light condensation into parallel rays well. That is, as the maximum intensity of the lighting device increases, the lighting device may have an intensity distribution which exhibits better light condensation into parallel rays. Here, the rate of increase may be a percentage of the maximum intensity of the lighting device 100 having the lens 140 with respect to the maximum intensity of the lighting device without the lens 140.

Referring to FIG. 8, Cases 1 to 5 may have a maximum intensity increase rate of 10% or more. Here, α may be 33° to 67°, and β may be 23° to 57°. In this case, the angle 2β between the first reference line 102*a* and the second reference line 102*b* may be 46° to 114°.

Alternatively, the lighting device 100 according to an embodiment may have a maximum intensity increase rate of 30% or more. Referring to FIG. 8, Cases 1 to 3 may have a maximum intensity increase rate of 30% or more. Here, α may be 33° to 51°, and β may be 39° to 57°. In this case, the angle 2β between the first reference line 102*a* and the second reference line 102*b* may be 78° to 114°.

Alternatively, the lighting device 100 according to an embodiment may have a maximum intensity increase rate of 60% or more. Referring to FIG. 8, Cases 1 and 2 may have a maximum intensity increase rate of 60% or more. Here, α may be 33° to 37°, and β may be 53° to 57°. In this case, the angle 2β between the first reference line 102*a* and the second reference line 102*b* may be 106° to 114°.

Figure 6:
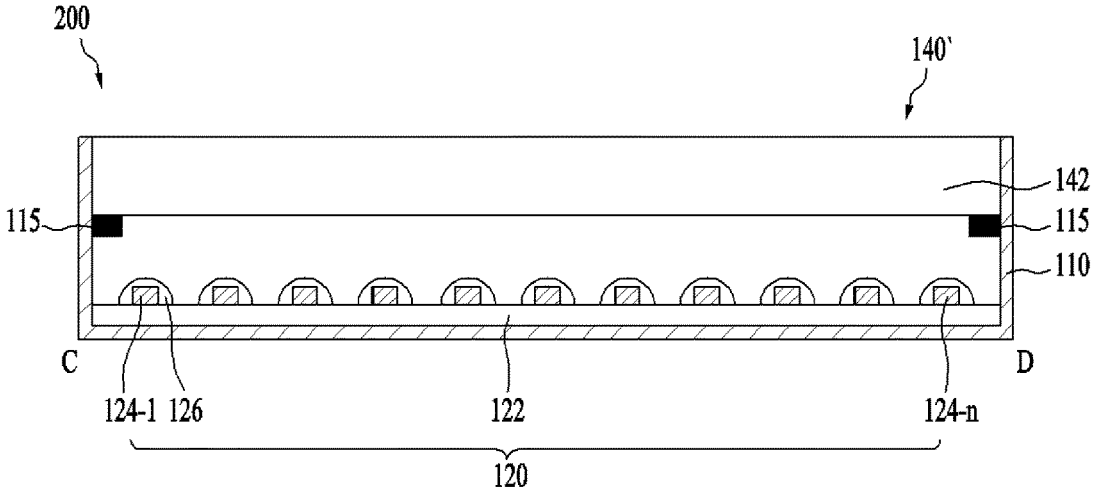
FIG. 6 shows a cross-sectional view of a lighting device according to another embodiment, taken along line CD.

FIG. 6 shows a cross-sectional view of a lighting device according to another embodiment, taken along line CD.

The perspective view of FIG. 6 may be the same as FIG. 1 except for a protruding support 115 of FIG. 6, and the cross-sectional view taken along line AB may be the same as FIG. 2A. The same reference numerals as used in FIGS.

1, 2A and 2B represent the same constituents, and the description of the same constituents will be simplified or omitted.

Referring to FIG. 6, a lens 140' of a lighting device 200 does not have the support 144 of FIG. 1. The housing 110 of the lighting device 200 has a protruding support 115 on the inner wall thereof. The protruding support 115 supports one end and the opposite end of the lower surface of the refractor 142 of the lens 140'.

Accordingly, the lens 140' may be supported by the protruding support 115 provided on the inner wall of the housing 110.

In the embodiment shown in FIG. 6, the support 114 is not provided, and therefore the light emitted from the light emitting elements 124-1 to **124-*n* may be prevented from being refracted by the support 114 of the lens 140**, the condensing efficiency may be improved as designed by Equations 1 to 3.

Compared to a red LED, blue LED, green LED, or white LED, a UV LED is a point light source that provides a relatively small amount of light. Therefore, if a light emitting module is configured with only the UV LED, light condensing capability is degraded.

When the target distance increases, the number of UV LEDs included in the light emitting module needs to be increased to meet the target irradiance. In addition, as the target distance increases, not only irradiance but also light uniformity is lowered.

In this embodiment, light may be uniformly condensed on a target having a certain area by converting light emitted from a UV LED light source into parallel rays using the parabolic reflective surfaces **132*a* and 134*a* and the condenser lens 140**. The target may be, but is not limited to, a light receiving device, an optical fiber, an optical cable, an exposure device, a detector, an endoscope, or a sensor.

In addition, as the lighting device 100 according to the embodiment is provided with the first and second reflectors 132 and 134 and the lens 140 according to Equations 1 to 3, it may have a maximum intensity increase rate of 10% or more.

Figure 10:
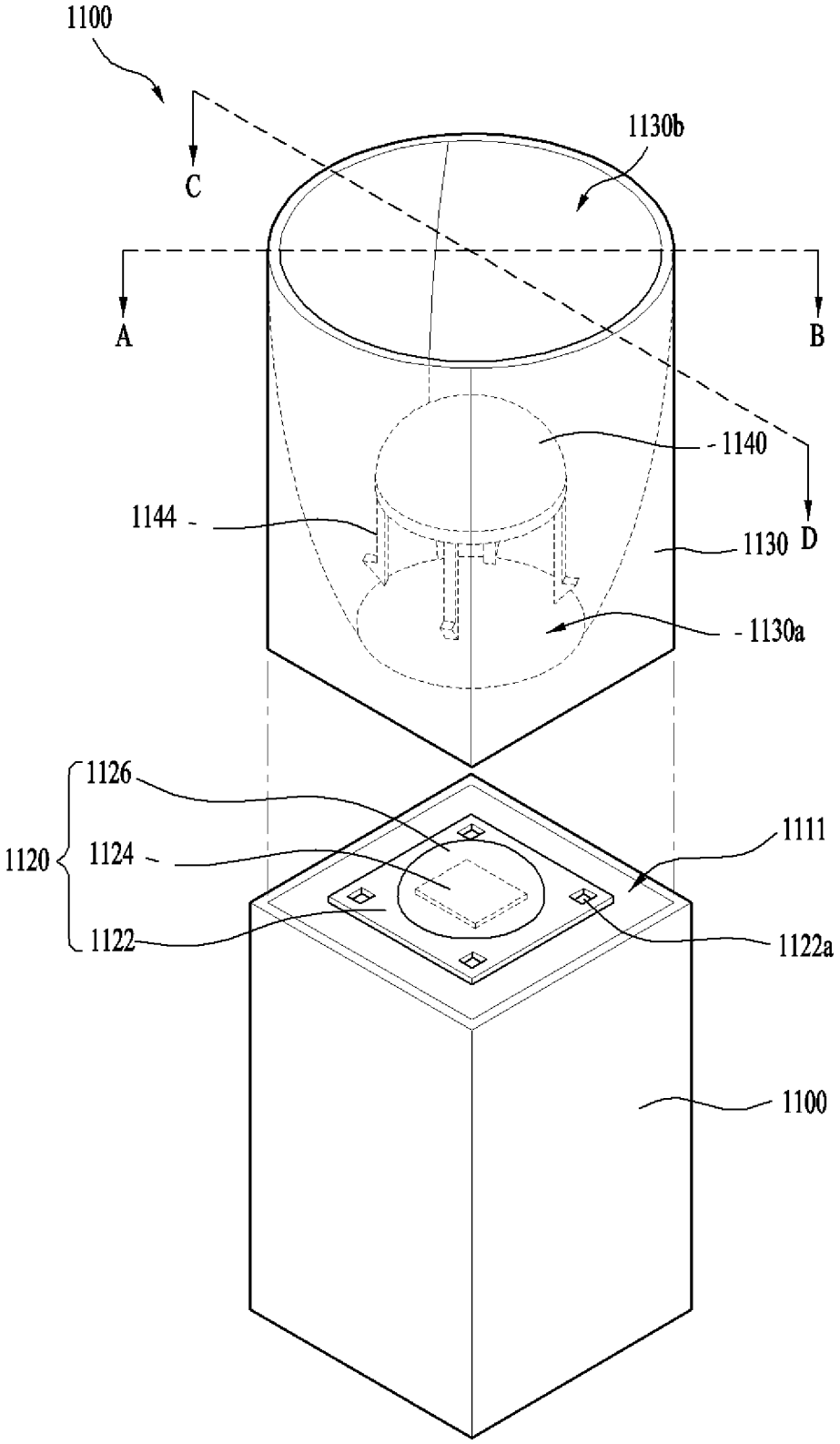
FIG. 10 shows an exploded perspective view of a lighting device according to an embodiment.
Figure 11:
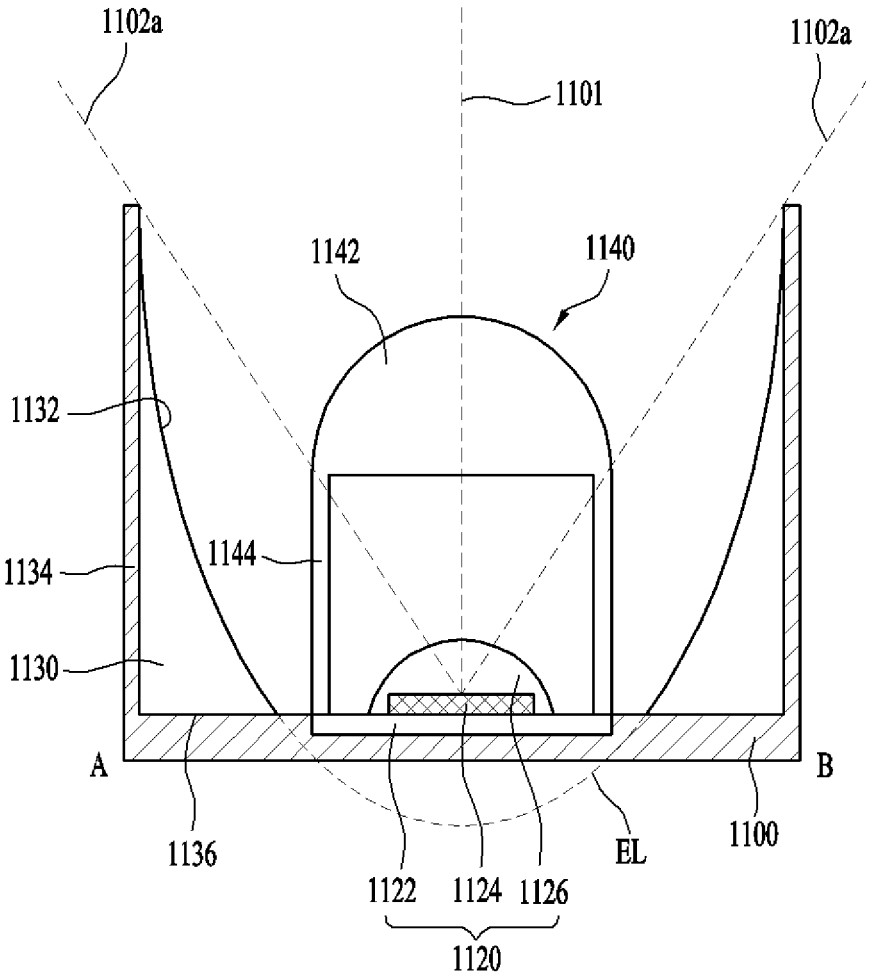
FIG. 11 shows a cross-sectional view of the lighting device shown in FIG. 10, taken along line AB.
Figure 12:
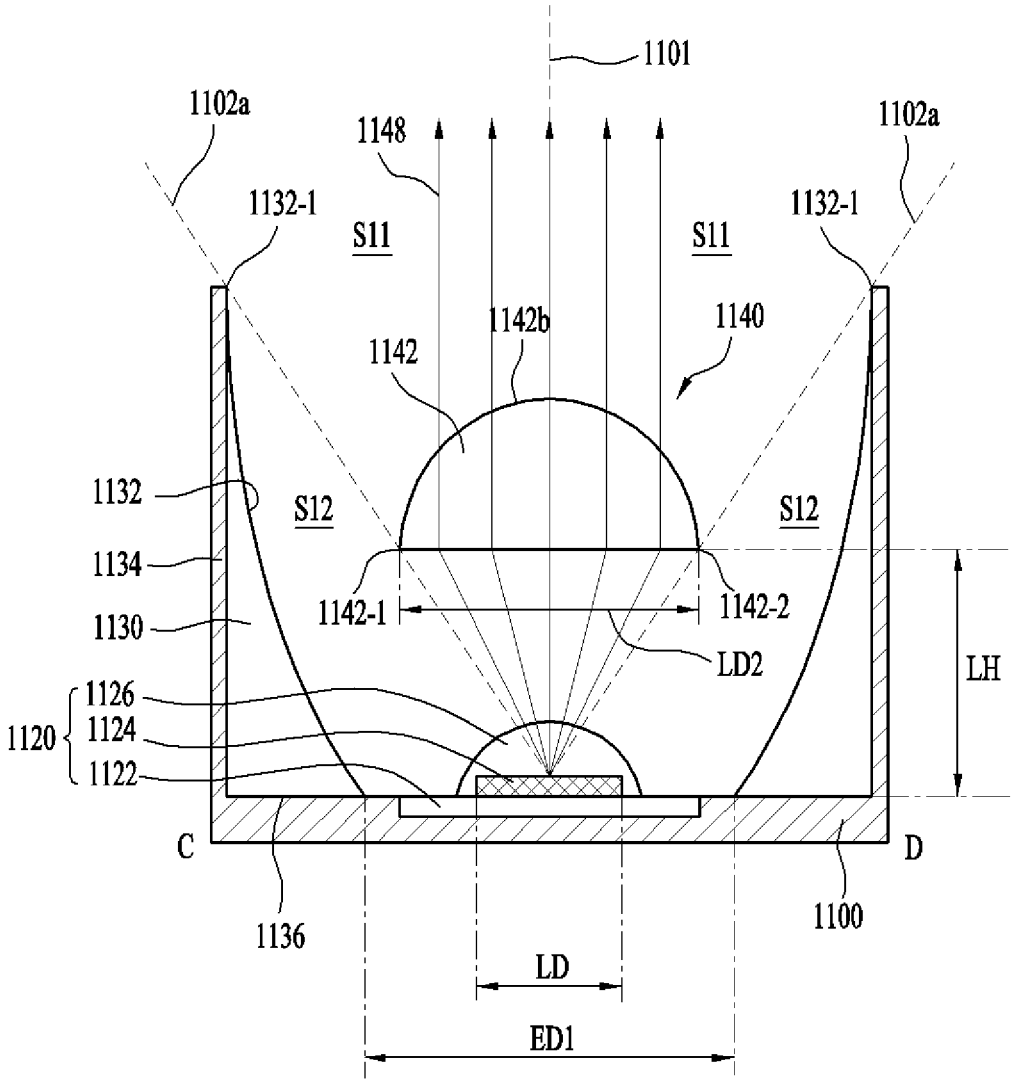
FIG. 12 shows a cross-sectional of the lighting device shown in FIG. 10, taken along line CD.

FIG. 10 shows an exploded perspective view of a lighting device 1100 according to an embodiment, FIG. 11 shows a cross-sectional view of the lighting device 1100 shown in FIG. 10, taken along line AB, and FIG. 12 shows a cross-sectional of the lighting device 1100 shown in FIG. 10, taken along line CD.

Referring to FIGS. 10 to 12, the lighting device 1100 includes a housing 1110, a light emitting unit 1120, a reflector 1130, and a lens 1140.

The housing 1110 has a cavity 1111 for accommodating the light emitting unit 1120, the reflector 1130, and the lens 1140.

The housing 1110 may be formed of a plastic material having a light weight and high heat resistance, or a metal material having high thermal conductivity, such as, for example, aluminum. The inner wall of the housing 1110 may be coated with a reflective material capable of reflecting light emitted from the light emitting unit 1120. In other embodiments, the housing 1110 may be formed of a reflective material that reflects light.

The light emitting unit 1120 is disposed in the housing 1110 and emits light.

The light emitting unit 1120 may include a board 1122 and a light emitting element 1124. The light emitting unit 1120 may further include a resin layer 1126 for surrounding the light emitting element 1124. The resin layer 1126 may protect the light emitting element 1124 and refract light emitted from the light emitting element 1124. For example, the resin layer 1126 may serve as a lens for refracting light.

The board 1122 of the light emitting unit 1120 may be a plate-shaped structure on which the light emitting element 1124 and an element capable of supplying power to the light emitting element 1124, controlling the light emitting element, or protecting the light emitting element may be mounted.

For example, the board 1122 may be a printed circuit board or a metal PCB. In FIG. 10, the board 1122 may have a cubic plate shape. However, embodiments are not limited thereto. The board may have a circular, elliptical, or polyhedral plate shape.

The light emitting element 1124 is disposed on one surface (e.g., the top surface) of the board 1122. The light emitting element 1124 may be a light emitting diode (LED)-based light source, but is not limited thereto. For example, the light emitting element 1124 may take the form of an LED chip, or an LED package.

The number of the light emitting elements 124 may be one or more. While it is illustrated in FIG. 10 that one light emitting element is disposed on the board 1122, embodiments are not limited thereto. For example, in another embodiment, a plurality of light emitting elements may be disposed in a line on the board, or may be disposed in various shapes such as a circular shape or a matrix shape on the board 1122.

The light emitting element 1124 may emit visible light or light in an infrared wavelength range.

For example, the light emitting element 1124 may emit light in a wavelength range of blue, red, or green. Alternatively, the light emitting element 1124 may emit light in a white wavelength range.

Alternatively, for example, the light emitting element 1124 may emit ultraviolet light having a wavelength range of 200 nm to 400 nm. Alternatively, for example, the light emitting element 1124 may generate ultraviolet-C (UVC) in a wavelength range of 200 nm to 280 nm.

When a plurality of light emitting elements is provided, the plurality of light emitting elements may emit rays in the same wavelength range or similar wavelength ranges. At least one of the plurality of light emitting elements may emit light in a different wavelength range.

The reflector 1130 may include a reflective surface 1132 disposed to surround the light emitting element 1124 and configured to reflect light emitted from the light emitting unit 1120.

For example, the reflector 1130 may include a first opening **1130*a* adjacent to the light emitting unit 1120 and positioned at a lower end, a second opening 1130*b* positioned over the first opening 1130*a* and allowing light emitted from the light emitting unit 1120 to be output therethrough, and a reflective surface 1132 positioned between the first opening 1130*a* and the second opening 1130*b*. The diameter of the second opening 1130*b* is greater than the diameter of the first opening 1130*a***.

The first opening **1130*a* and the second opening 1130*b* shown in FIG. 10** have a circular shape, but embodiments are not limited thereto. In another embodiment, they may have an elliptical shape or a polygonal shape.

The vertical cross-section of the reflective surface 1132 may have an elliptical shape or have a curvature of an ellipse. For example, the vertical cross-section of the reflective surface 1132 may be a plane passing through the center of the first opening **1130*a* and the center of the second opening 1130*b***.

For example, in FIG. 11, the reflective surface 1132 and an extension line of the lower end of the reflective surface 1132 may form an ellipse EL. The extension line of the lower end of the reflective surface 1132 may form a vertex of the ellipse EL.

The light emitting element 1124 may be aligned to be positioned at the focus of the ellipse EL.

The light emitting unit 1120 may be disposed spaced apart from the reflective surface 1132, and the center of the light emitting unit 1120 may be aligned with a vertical reference line 1101. Here, the center of the light emitting unit 1120 may be the center of the light emitting element 1124. The center of the light emitting element 1124 may be the center of the light emitting surface of the light emitting element 1124.

The vertical reference line 1101 may be an imaginary line passing through the center of the reflector 1130 and the center of the lens 1140 and perpendicular to the top surface of the board 1122. For example, the vertical reference line 1101 may be an imaginary line passing through the center of the first opening 1130*a* of the reflector 1130, the center of the second opening 1130*b* and the center of the lens 1140 and perpendicular to the top surface of the board 1122.

The reflector 1130 may include a reflective surface 1132 having a vertical cross-section in an elliptical shape, a side surface 1134 positioned opposite the reflective surface 1132, and a lower surface 1134 positioned between the reflective surface 1132 and the side surface 1134.

The reflector 1130 may be formed of a reflective metal, for example, stainless steel or silver (Ag). Alternatively, the reflector 1130 may be a metal material causing specular reflection.

Alternatively, the reflector 1130 may be formed of a resin material having high reflectivity, but embodiments are not limited thereto.

The lens 1140 is disposed in a space inside the reflective surface 1132 on the light emitting unit 1120, and refracts and transmits light emitted from the light emitting unit 1120. For example, the center of the lens 1140 may be aligned with the center of the light emitting unit 1120, the center of the first opening 1130*a*, and the center of the second opening 1130*b*.

The lens 1140 may include a refractor 1142 which is convex in a direction pointing from the lower end to the upper end of the reflector 1130 or pointing from the light emitting unit 1120 to the lens 1140 and a support 1144 provided on the lower surface of the refractor 1142.

The support 1144 of the lens 1140 may be coupled to a coupling groove 1122*a* provided on the top surface of the board 1122 and support the lens 1140. For example, the support 1144 take the form of a leg connected to the lower surface of the refractor 1142 of the lens 1140, and the number of the supports 1144 may be greater than or equal to two. One end of the support 1144 may be provided with an engagement portion to be coupled with the coupling groove 1122*a* of the board 1122.

In FIG. 10, the number of the supports 1144 is four, but embodiments are not limited thereto.

For example, in order to suppress refraction of light emitted from the light emitting unit 120 caused by the supports 1144, the supports 1144 may be spaced apart from each other and connected to the lower surface of the refractor 1142.

While it is illustrated in FIG. 10 that the supports 1144 of the lens 1140 are coupled to a groove 1122*a* provided in the board 122, embodiments are not limited thereto. In another embodiment, the supports 1144 of the lens 1140 may be coupled to a groove (not shown) provided in the lower surface of the cavity 1111 of the housing 1110.

In another embodiment, the groove 1122*a* may not be provided in the board 1122, but the supports 1144 may be fixed to the board 1122 or the lower surface of the cavity 1111 of the housing 1110 by an adhesive member.

FIG. 12 shows light refracted by the lens 1140.

The refractor 1142 of the lens 1140 may include an incidence surface 1142*a* and an exit surface 1142*b*.

The incidence surface 1142*a* of the refractor 1142 of the lens 1140 may be a surface on which light emitted from the light emitting element 1124 is incident and refracted, and may be spaced apart from the reflective surface 1132.

The exit surface 1142*b* of the refractor 1142 of the lens 1140 refracts and passes the light that has passed through the incidence surface 1142*a*. The light that has passed through the incidence surface 1142*a* and the exit surface 1142*b* of the refractor 1142 of the lens 1140 may be converted into rays 1148 parallel to the direction pointing from the light emitting unit 1120 to the lens 1140.

For example, the incidence surface 1142*a* of the lens 1140 may be a flat surface parallel to the top surface of the board 1122, and the exit surface 1142*b* may have a hemispherical shape, a parabolic shape, or an elliptical shape that is convex in a direction pointing from the light emitting unit 1120 to the lens 1140. However, embodiments are not limited thereto. In another embodiment, the incidence surface 1142*a* and the exit surface 1142*b* may be embodied in various shapes to convert the light passing through the incidence surface 1142*a* and the exit surface 1142*b* into parallel rays 1148.

The inner space of the reflective surface 1132 and the space between the lens 1140 and the light emitting unit 1120 may be filled with a gas such as, for example, air, but embodiments are not limited thereto. In another embodiment, the spaces may be filled with a translucent material.

An edge 1142-1 of the lens 1140 may be spaced apart from an imaginary reference line 1102*a* connecting the center of the light emitting element 1124 and the uppermost end 1132-1 of the reflective surface 1132*a*. Alternatively, the edge 1142-1 of the lens 1140 may be aligned with or adjacent to the imaginary reference line 1102*a*.

If the edge 1142-1 of the lens 1140 overlaps the imaginary reference line 1102*a*, the light reflected by the reflective surface 1132 and the light refracted by the lens 1140 may interfere with each other, and light may not be focused on a target as desired due to such light interference.

The edge 1142-1 of the lens 1140 may be the corner of the lens 1140 where the incidence surface 1142*a* of the lens 1140 and the exit surface 1142*b* adjoin each other.

When a plurality of light emitting elements 1124 is provided, the center of the light emitting elements 1124 may be the center of a region where the light emitting elements are distributed.

The light of the light emitting element 1124 emitted onto a first region S11 of the reflector 1130 may be refracted by the lens 1140, and the refracted light may be converted into rays 1148 parallel to a direction pointing from the light emitting unit 1120 to the lens 1140 and be output.

Here, the first region S11 of the reflector 130 may be a region positioned on one side of the imaginary reference line 1102*a* connecting the center of the light emitting element 1124 and the uppermost end 1132-1 of the reflective surface 1132*a*.

For example, the first region S11 of the reflector 1130 may be an inner region of a closed curved surface (e.g., a cone) formed by the imaginary reference lines 1102*a* connecting the center of the light emitting element 1124 and the uppermost end 1132-1 of the reflective surface 1132*a*.

For example, the light emitted from the light emitting element 1124 upward of the reference line 1102*a* may be refracted by the lens 1140, and the refracted light may be converted into the rays 1148 parallel to the direction pointing from the light emitting unit 1120 to the lens 1140 and be output.

Figure 13:
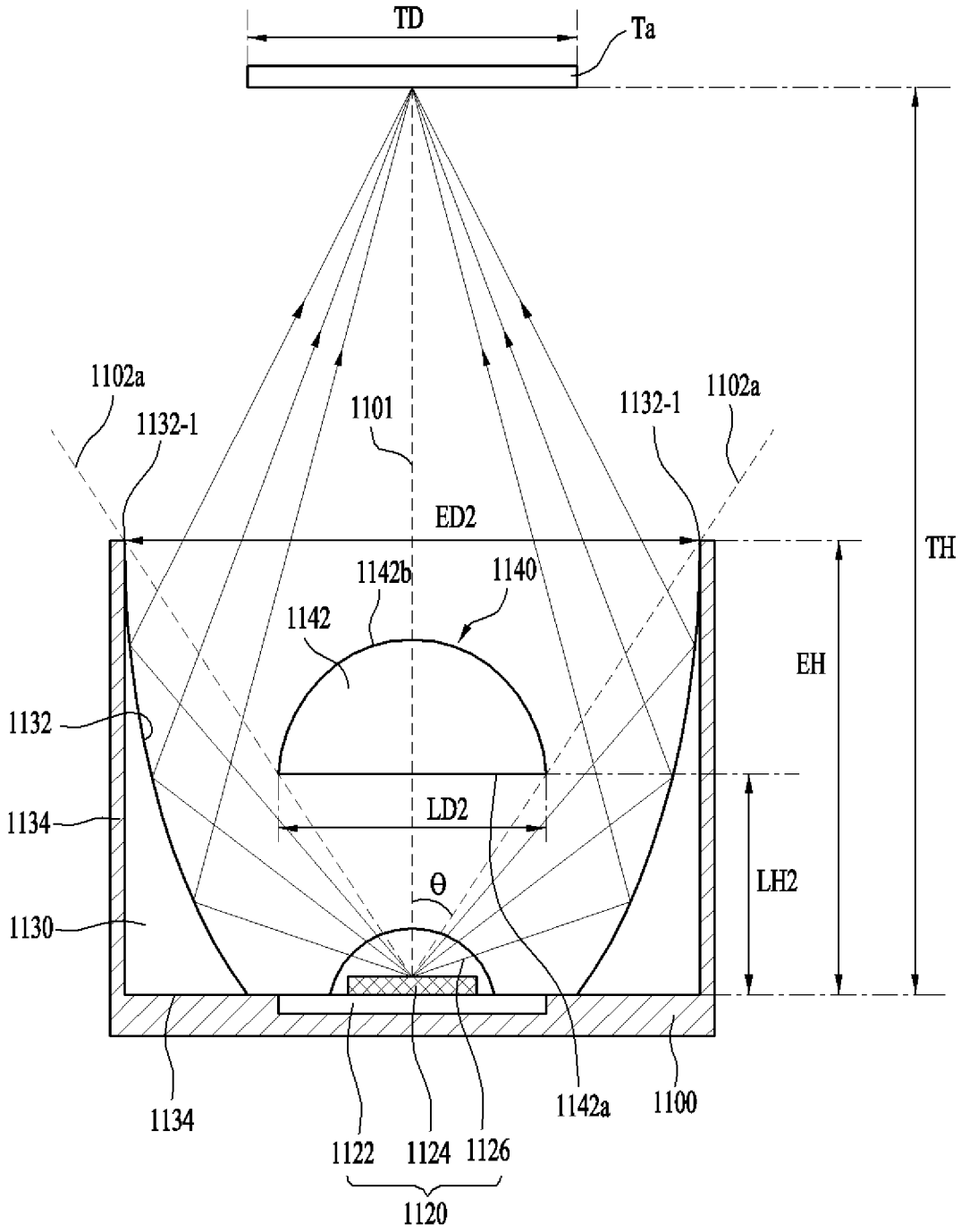
FIG. 13 shows light reflected by the reflective surface of the reflector shown in FIG. 10.
Figure 14:
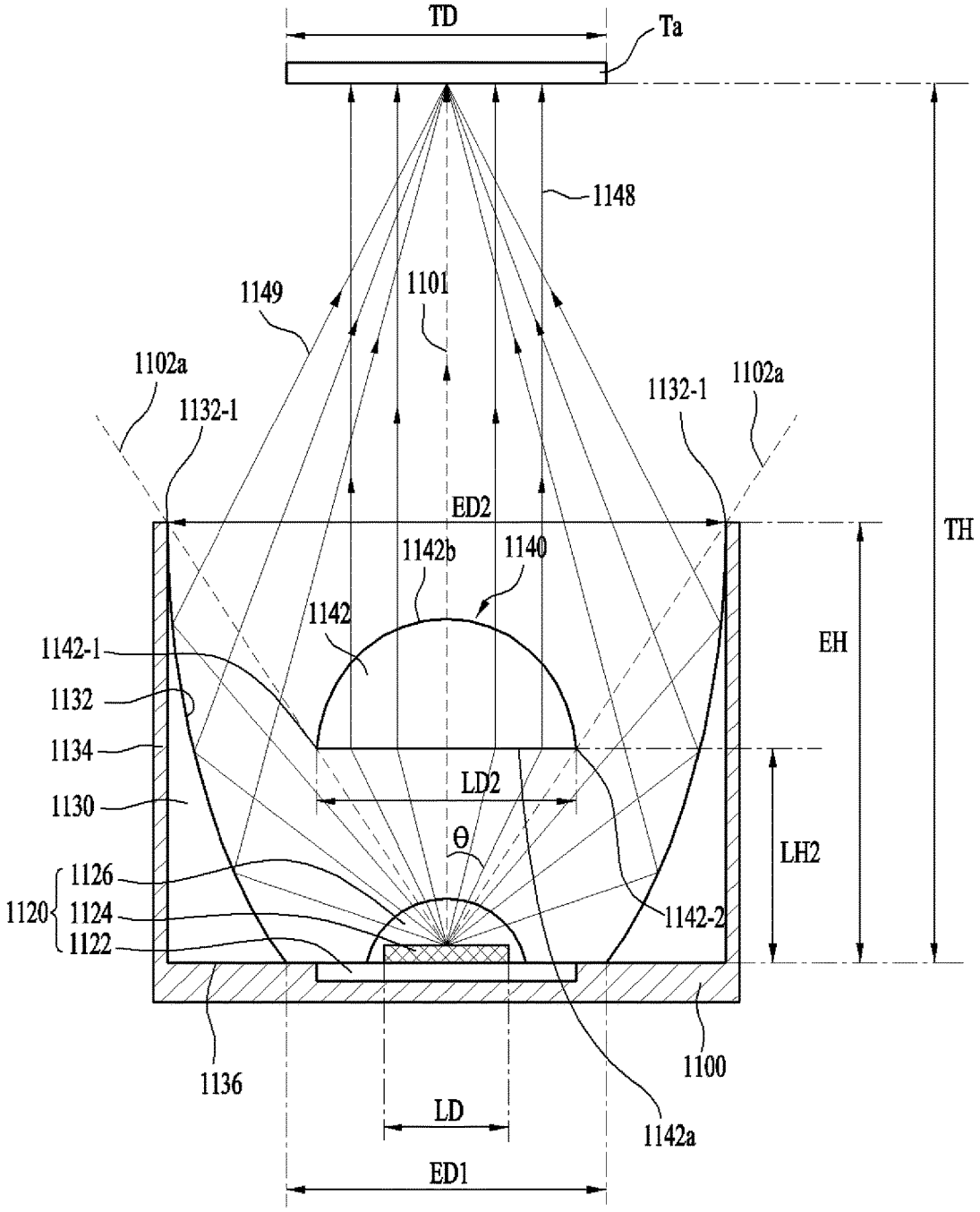
FIG. 14 shows the size of a reflective surface, the size and position of a lens, and the size and position of a target.

FIG. 13 shows light 1149 reflected by the reflective surface 1132 of the reflector 1130 shown in FIG. 10, and FIG. 14 shows the size of the reflective surface 1132, the size and position of the lens 1140, and the size and position of a target Ta.

Referring to FIGS. 13 and 14, the light of the light emitting element 1124 emitted downward of the reference line 1102*a* is reflected by the reflective surface 1132 without being refracted by the lens 1140. Since the reflective surface 1132 has an elliptical shape, the light 1149 reflected by the reflective surface 1132 may be condensed on the target Ta positioned at a certain distance.

The light of the light emitting element 1124 emitted downward of the reference line 1102*a* may pass through the vertical reference line 1101 by reflection on the reflective surface 1132 and be condensed on the target Ta or may be condensed on the target Ta so as to be aligned with the vertical reference line 1101.

Referring to FIGS. 12 and 13, the diameter ED1 of the first opening 1130*a* of the reflector 1130 may be 1.2×LD to 5.0×LD. For example, LD may be the diameter of the light emitting surface of the light emitting element 1124, and ED1 may be the diameter of the lowermost end of the reflective surface 1132.

If the diameter ED1 of the first opening 1130*a* is greater than or equal to 1.2×LD, light generated from the light emitting element 1124 may be transmitted to the reflective surface 1132 without loss. If the diameter ED1 of the first opening 1130*a* is less than 1.2×LD, loss of the amount of light emitted from the light emitting element 1124 may occur.

If the diameter ED1 of the first opening 1130*a* exceeds 5.0×LD, the diameter of the first opening 1130*a* is excessively large compared to the area of the light source to increase the loss of the light amount, thereby resulting in increase in loss of the light amount and thus decrease in optical power.

In an embodiment, the diameter TD of the target Ta may be 1.2×LD to 1.5×LD such that light may be condensed on the target Ta having a diameter similar to the diameter LD of the light emitting surface of the light emitting element 1124.

The distance TH from the lower surface 1136 of the reflector 1130 to the target Ta may be 1.0×LD to 4.5×LD.

If TH is greater than 4.5×LD, the condensation distance is increased, and therefore the power of condensed light is reduced to below 40%.

If TH is less than 1.0×LD, the distance TH from the lower surface 1136 of the reflector 1130 to the target Ta may become too short to obtain the light condensation effect through the reflector 1130 and the lens 1140.

The angle θ between the vertical reference line 1101 and the reference line 1102*a* is defined by Equation 4.

$$\theta = \tan^{-1}\left(\frac{ED2}{\frac{2}{EH}}\right) \quad \text{Equation 4}$$

ED2 may be the diameter of the second opening 1130*b*. For example, ED2 may be the diameter of the uppermost end of the reflective surface 1132.

EH denotes the height of the reflector 1130. For example, EH may be the distance from the lower surface 1136 of the reflector 1130 to the uppermost end 1132-1 of the reflective surface 1132.

The angle θ between the vertical reference line 1101 and the reference line 1102*a* may be 30° to 51°.

If the angle θ is less than 30°, the focal length a1 of the elliptical shape EL is increased and thus the amount of light falls. If the angle θ is greater than 51°, the focal length a1 of the elliptical shape EL is reduced, and it is difficult to condense light.

The diameter LD2 of the lens 1140 is defined by Equations 5 and 6.

$$LD2 = k \times B, \text{ and} \quad \text{Equation 5}$$

$$B = 2 \times LH2 \times \tan(\theta), \quad \text{Equation 6}$$

k denotes a constant related to interference of light rays, and may be $0.8 \le k \le 1$.

When k=1, the edge 1142-1 of the lens 1140 may be aligned with the imaginary reference line 1102*a*.

When k>1, the edge 1142-1 of the lens 1140 overlaps the imaginary reference line 1102*a*, and thus light interference may occur.

When k<0.8, the diameter of the lens 1140 may become small, and the light condensing effect may not be obtained through by the lens 1140.

LH2 denotes the height of the lens 1140.

For example, LH2 may be the distance from the lower surface 1136 of the reflector 1130 to the incidence surface 1142*a* of the lens 1140.

The height LH2 of the lens 1140 is set to half the height EH of the reflector 1130, in consideration of the fact that the lens 1140 has a curvature of an ellipse and the distance to the target Ta. The curvature of the lens 1140 may depend on the distance TH to the target.

That is, as the area in which the lens 1140 condenses light decreases, the height of the curvature of the lens 1140 may increase and the distance TH to the target Ta may increase. Considering the distance to the target at which the lens 1140 having an elliptical curvature can condense light, the embodiment may set LH2 to half the height EH, thereby concentrating 25% to 60% of the light emitted from the light emitting element 1124 at the desired target Ta.

In Equation 6, when LH2 is half the height EH of the reflector 1130, B may be half the diameter of the uppermost end of the reflective surface 1132 or half the diameter ED2 of the second opening 1130*b*.

The light of the light emitting element 1124 emitted onto the second region S12 of the reflector 1130 may be condensed in a target region by the reflector 1130.

The embodiment may concentrate at least 40% of the total optical power of the light emitted from the lighting device in the target area even when the loss of light caused by the lens 1140 is considered.

FIG. 15 shows conditions for each case for the simulation result of FIG. 16, and FIG. 16 shows a simulation result of light condensation of the lighting device according to FIG. 15.

LES denotes the diameter of the light emitting surface of the light emitting element 1124. LES may be 3.5 mm, and the size of the target, e.g., the detector, may be 5 mm×5 mm. Here, the detector may measure the power or light amount of the received light.

F1 and F2 denote the focuses of an ellipse, R is the vertex radius of the ellipse, k is a conic constant, and F is the distance from the origin of the ellipse to the focus (or the light emitting element 1124).

The total collected power represents the collected power of the entire light output from the lighting device, and the detector collected power represents the power of light detected by the target Ta, for example, the detector, and the rate represents the ratio of the total collected power to the detector collected power.

The size of the target Ta, for example, the detector may be 1.2 times to 1.5 times the diameter of the light emitting surface.

Referring to FIGS. 15 and 16, the rate may be 40% or more in Cases 1 to 4, and θ may be 30° to 51°.

Figures 18, 19:
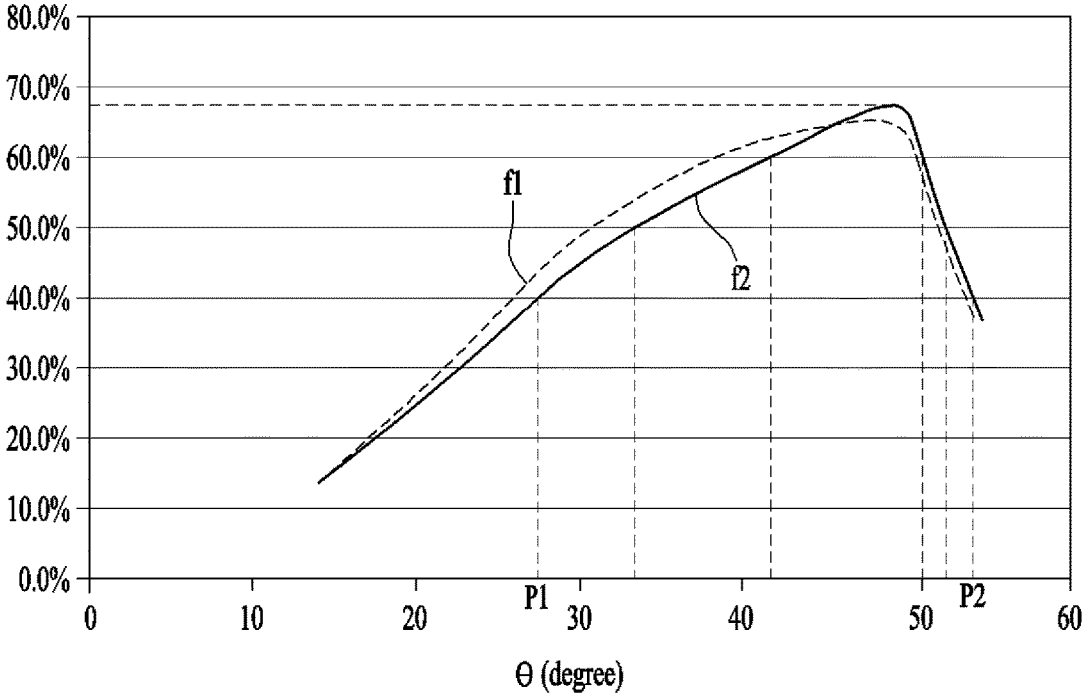
FIG. 18 shows a simulation result of light condensation of a lighting device according to the conditions of FIG. 17.
FIG. 19 is a graph of the simulation results of FIGS. 16 and 18.

FIG. 17 shows conditions for each case for the simulation result of FIG. 18, and FIG. 18 shows a simulation result of light condensation of a lighting device according to the conditions of FIG. 17.

LES may be 14.5 mm, and the size of the target, e.g., the detector, may be 18 mm×18 mm.

Referring to FIGS. 17 and 18, the rate may be 40% or more in Cases 1 to 4, and θ may be 30° to 51°.

FIG. 19 is a graph of the simulation results of FIGS. 16 and 18.

f1 is a curve according to the simulation result in FIGS. 16, and f2 is a curve according to the simulation result in FIG. 18.

Referring to FIG. 19, the value P1 of θ at which the rate is 40% is 28°.

θ of the lighting device 100 according to the embodiment may be greater than or equal to 30° and less than or equal to 51° such that the rate is 40% or more in consideration of a margin of error of 2°.

When θ is greater than 51°, the height EH of the reflective surface 1132 becomes too small, and thus it is difficult for the reflective surface 1132 to have an elliptical shape, and thus light may not be condensed on a desired target. Therefore, the upper limit of θ is set to 51°.

When θ is 30° to 51°, the rate may be higher than or equal to 40% and lower than or equal to 68%.

θ may be set between 34° and 51° such that the rate is higher than 50%.

In order to make the rate higher than or equal to 60%, θ may be between 42° and 50°.

When an LED having a relatively small light amount compared to a lamp having a large light amount is used as a light source to concentrate the power of the light source on an optical fiber or a detector having a size similar to that of the light source, it is difficult to concentrate the power of the light source over the entire area of the detector using a simple reflector.

Embodiments have the following effects.

First, the amount of light lost to an optical system group may be reduced by using a condensing lens as a central lens of the reflector having an elliptical reflective surface for condensing light.

Second, an optical system that uses multiple lenses for condensing light typically exhibits system efficiency of about 70%, whereas embodiments may exhibit system efficiency of at least about 84% by using two optical elements, e.g., two lenses, and facilitate alignment of the optical axis.

Third, the size and position of the lens may be easily adjusted according to a rule based on the area and distribution of the light emitting element 1124.

For a target Ta having TH of 1.0×LD to 4.5×LD and the diameter of 1.2×LD to 1.5×LD, embodiments may concentrate 40% or more of the total collected power of the amount of light output from the reflector 1130 on the target Ta.

The features, structures, effects and the like described in the embodiments are included in at least one embodiment of the present disclosure and are not necessarily limited to only one embodiment. Further, the features, structures, effects, and the like illustrated in the embodiments may be combined and modified for other embodiments by those having ordinary skill in the art to which the embodiments belong. Therefore, it is to be understood that these combinations and modifications should be understood as being within the scope of the present disclosure.

INDUSTRIAL APPLICABILITY

The embodiments may be used for a lighting device capable of uniformly condensing light on a target having a certain area.

The invention claimed is:

1. A lighting device comprising:

a light emitting unit comprising a board and a plurality of light emitting elements disposed on a top surface of the board;

a reflector comprising a first reflective surface positioned on one side of the light emitting unit and a second reflective surface positioned on an opposite side of the light emitting unit, the first reflective surface and the second reflective surface having a parabolic shape; and a lens disposed on the light emitting unit between the first reflective surface and the second reflective surface, wherein each of the light emitting elements is arranged to be aligned with a focus of the parabolic shape, and a height of the reflector is defined by Equation 1 defined as follows:

$$Z = \frac{(PD/2)^2}{4a}, \qquad \text{Equation 1}$$

where Z is the height of the reflector, a is a focal length of the parabolic shape, and PD is a distance from an uppermost end of the first reflective surface to an uppermost end of the second reflective surface.

2. The lighting device according to claim 1, wherein Z≥0.89 A, and A is a diameter of the light emitting elements.

3. The lighting device according to claim 1, wherein a distance between a lowermost end of the first reflective surface and a lowermost end of the second reflective surface is greater than or equal to 4a.

4. The lighting device according to claim 1, wherein the lens comprises a refractor comprising:

an incidence surface on which light emitted from the light emitting elements is incident; and an exit surface through which light passing through the incidence surface passes, wherein the light passing through the refractor is output in parallel with a direction perpendicular to the top surface of the board.

5. The lighting device according to claim 4, wherein a diameter of the incidence surface of the lens is defined by Equation 2 as follows:

$$LD=(2\alpha\times\tan\theta+\sqrt{(2\alpha\times\tan\theta)^2+4\alpha^2})\times 2, \qquad \text{Equation 2}$$

where LD is the diameter of the incidence surface of the lens, and θ is an angle of light emitted from the light emitting elements having a luminous intensity of 10% of a maximum value of an intensity distribution.

6. The lighting device according to claim 5, wherein a height of the lens is defined by Equation 3 as follows:

$$LZ = \tan\alpha \times \frac{LD}{2}, \quad \text{Equation 3}$$

where LZ is the height of the lens, and α is an angle between the top surface of the board and a reference line, wherein the reference line is an imaginary line connecting a center of each of the light emitting elements and an uppermost end of the first reflective surface or the second reflective surface.

7. The lighting device according to claim 6, wherein α is 33° to 67°.

8. The lighting device according to claim 6, wherein α is 33° to 51°.

9. The lighting device according to claim 6, wherein α is 33° to 37°.

10. The lighting device according to claim 1, wherein a first edge of the lens contacts the first reference line, and a second edge of the lens contacts the second reference line, wherein and the first reference line is an imaginary line connecting a center of each of the light emitting elements and an uppermost end of the first reflective surface, and the second reference line is an imaginary line connecting the center of each of the light emitting elements and an uppermost end of the second reflective surface.

11. The lighting device according to claim 4, wherein the lens further comprises a support connected to the refractor and fixed to the top surface of the board, wherein the support is coupled to a second region of the top surface other than a first region of the board, the light emitting elements being positioned in the first region.

12. The lighting device according to claim 1, further comprising:

a housing having a cavity for accommodating the light emitting unit, the reflector, and the lens, wherein an inner wall of the housing is provided with a protruding support for supporting opposite ends of the lens.

13. The lighting device according to claim 1, wherein each of the light emitting elements generates ultraviolet light in a wavelength range of 200 nm to 400 nm.

14. A lighting device comprising:

a light emitting unit comprising a board and at least one light emitting element disposed on a top surface of the board;

a reflector comprising a first opening positioned around the light emitting unit, a second opening positioned over the first opening and allowing light emitted from the light emitting unit to be output therethrough, and a reflector comprising a reflective surface positioned between the first opening and the second opening; and a lens disposed on the light emitting unit on an inner side of the reflective surface and having an incidence surface and an exit surface, wherein the reflective surface is an elliptic shape and a corner where the incidence surface and the exit surface of the lens meet is aligned to contact a reference line, wherein the reference line is an imaginary line connecting a center of the at least one light emitting element and an uppermost end of the reflective surface, wherein an angle between a vertical reference line and the reference line is 30° to 51°, wherein the vertical reference line is an imaginary line passing through a center of the reflector and a center of the lens and perpendicular to the top surface of the board.

15. The lighting device according to claim 14, wherein a diameter of the first opening of the reflector is greater than or equal to 1.2 times a diameter of a light emitting surface of the light emitting element and is less than or equal to 5.0 times the diameter of the light emitting surface of the light emitting element.

16. The lighting device according to claim 14, wherein a height of the lens is half a height of the reflector.

17. The lighting device according to claim 14, wherein 40% or more of a total collected power is concentrated on a target spaced apart from a lower surface of the reflector and positioned in front of the second opening.

18. The lighting device according to claim 17, wherein a diameter of the target is greater than or equal to 1.2 times a diameter of a light emitting surface of the light emitting element and is less than or equal to 1.5 times the diameter of the light emitting surface of the light emitting element.

19. The lighting device according to claim 17, wherein a distance from the lower surface of the reflector to the target is greater than or equal to 1.0 time a diameter of a light emitting surface of the light emitting element and is less than or equal to 4.5 times the diameter of the light emitting surface of the light emitting element.

20. The lighting device according to claim 16, wherein a diameter of the lens is defined by Equation 4 and 5 as follows:

$$LD2 = k \times B, \text{ and} \quad \text{Equation 4}$$

$$B = 2 \times LH2 \times \tan(\theta), \quad \text{Equation 5}$$

where LD2 is the diameter of the lens, B is half a diameter of the second opening, $0.8 \le k \le 1$, LH2 is a height of the lens, and θ is the angle between the vertical reference line and the reference line.

* * * * *